US008870176B2

(12) United States Patent
Yamamoto

(10) Patent No.: US 8,870,176 B2
(45) Date of Patent: Oct. 28, 2014

(54) SHEET PROCESSING APPARATUS WITH PRESSING UNIT

(75) Inventor: Kazuya Yamamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 286 days.

(21) Appl. No.: 13/371,717

(22) Filed: Feb. 13, 2012

(65) Prior Publication Data

US 2012/0207565 A1 Aug. 16, 2012

(30) Foreign Application Priority Data

Feb. 14, 2011 (JP) ..... 2011-028968

(51) Int. Cl.

| | |
|---|---|
| ***B65H 37/04*** | (2006.01) |
| ***G03G 15/00*** | (2006.01) |
| ***B42C 1/12*** | (2006.01) |
| *B42B 4/00* | (2006.01) |

(52) U.S. Cl.

CPC ..... *B42C 1/125* (2013.01); *B65H 2405/22* (2013.01); *G03G 15/6544* (2013.01); *B65H 2301/4223* (2013.01); *B42B 4/00* (2013.01); *B65H 37/04* (2013.01); *B65H 2408/1222* (2013.01); *B65H 2801/27* (2013.01)

USPC ..... 270/58.11; 270/58.12; 270/58.08

(58) Field of Classification Search

CPC ..... B65H 37/04

USPC ..... 270/58.08, 58.09, 58.11, 58.12

See application file for complete search history.

(56) References Cited

U.S. PATENT DOCUMENTS

| | | | | |
|---|---|---|---|---|
| 6,145,825 | A * | 11/2000 | Kunihiro et al. | 270/58.09 |
| 6,296,247 | B1 | 10/2001 | Tamura et al. | |
| 6,305,681 | B1 * | 10/2001 | Watanabe et al. | 270/58.08 |
| 6,494,449 | B2 | 12/2002 | Tamura et al. | |
| 6,799,759 | B1 * | 10/2004 | McNamara et al. | 270/58.08 |
| 7,419,150 | B2 * | 9/2008 | Kushida et al. | 270/58.07 |
| 7,520,505 | B2 * | 4/2009 | Thomas et al. | 271/220 |
| 7,693,480 | B2 * | 4/2010 | Nomura et al. | 399/410 |
| 7,726,639 | B2 * | 6/2010 | Sato | 270/58.04 |
| 7,862,023 | B2 * | 1/2011 | Ichihashi et al. | 270/58.09 |

(Continued)

FOREIGN PATENT DOCUMENTS

| | | | |
|---|---|---|---|
| JP | 2006-225119 A | | 8/2006 |
| JP | 2007-161472 A | | 6/2007 |
| JP | 2008-019028 A | | 1/2008 |
| JP | 2008290844 A | * | 12/2008 |
| JP | 4842725 B2 | | 10/2011 |

OTHER PUBLICATIONS

English language abstract for Patent publication No. JP 2008-019028 corresponds to JP-4842725-B2.

Japanese Office Action dated Jul. 15, 2014 issued in corresponding Japanese Application No. 2011-028968.

*Primary Examiner* — Patrick Mackey

(74) *Attorney, Agent, or Firm* — Harness, Dickey & Pierce, P.L.C.

(57) ABSTRACT

A sheet processing apparatus includes: a stacking unit that stacks conveyed sheets; an aligning unit that aligns the sheets stacked on the stacking unit in a sheet conveying direction; a binding unit that moves along an end portion of a bundle of the sheets on a binding portion side and performs a binding process for the bundle of the sheets that have been aligned by the aligning unit; a pressing unit that presses the bundle of the sheets at the end portion thereof on the binding portion side; and an interlocking unit that moves the pressing unit in association with a motion of the binding unit.

11 Claims, 21 Drawing Sheets

(56) References Cited

U.S. PATENT DOCUMENTS 7,922,163 B2 * 4/2011 Ichihashi et al. ..... 270/58.12
7,922,165 B2 * 4/2011 Kamiya ..... 270/58.17
8,162,306 B2 * 4/2012 Suzuki et al. ..... 270/58.12
2001/0050459 A1 12/2001 Tamura et al.
2007/0257421 A1 * 11/2007 Sanmiya ..... 271/221

* cited by examiner

SHEET PROCESSING APPARATUS WITH PRESSING UNIT

CROSS-REFERENCE TO RELATED APPLICATIONS

The present application claims priority to and incorporates by reference the entire contents of Japanese Patent Application No. 2011-028968 filed in Japan on Feb. 14, 2011.

BACKGROUND OF THE INVENTION

1. Field of the Invention

The present invention relates to a sheet processing apparatus that aligns and binds sheet-shaped members (simply referred to as "sheets" in the specification) such as sheets of paper, recording sheets, transfer sheets, or OHP sheets that are carried in, an image forming system that includes the sheet processing apparatus and an image forming apparatus such as a copying machine, a printer, a facsimile, or a digital multi-function peripheral (MFP), and a sheet processing method which is executed in the sheet processing apparatus.

2. Description of the Related Art

Conventionally, an apparatus called a finisher that includes a stapler is known; the finisher allows sheets discharged from an image forming apparatus to be stacked on a stapler tray, aligns the stacked sheets in a sheet-conveying direction (a so-called longitudinal direction) and a direction perpendicular to the sheet-conveying direction (a so-called width direction), and binds the aligned sheets together. In a case where end-face-binding of an end face is performed by using a stapler, the stapler moves in the direction perpendicular to the sheet conveying direction along a sheet edge portion (usually, the trailing end of a sheet) abutting on a reference fence that defines the position of the sheet in the conveying direction, so that the binding position can be changed. Then, in order to improve the alignment precision of the finishing of a bundle of bound sheets, the posture of the trailing end of the sheets stacked on the staple tray may be maintained. Thus, there is a known configuration in which a sheet bundle is pressed in a state in which the trailing end of the sheet bundle is abutting on the reference fence. Such a configuration includes a pressing member (trailing end pressing lever) 110 illustrated in FIG. 1 to be described later, and the pressing member 110 is provided at a lower end portion of a trailing-end reference fence 51 so as to press the trailing end of the sheet bundle SB housed in the trailing-end reference fence 51 and is configured to be capable of reciprocating in a direction approximately perpendicular to an end-face-binding processing tray F (see FIG. 7 to be described later).

However, in the sheet maintaining configuration of the conventional end binding process, and more specifically, in a configuration in which the posture of the sheet bundle (in particular, the trailing end thereof) is maintained inside the staple tray, a pressing member for pressing and maintaining the sheet bundle presses a position distant from the stapler in consideration of the interference thereof with the stapler. Accordingly, bending or the like occurs on the sheet bundle when the sheets are bound with a staple, making it difficult to achieve precise alignment. In addition, because the pressing member is fixed in the width direction of the sheet bundle, the pressing member sometimes presses a position located more distant from the position of the staple depending on the sheet size or the binding position.

Thus, for example, Japanese Patent Application Laid-open No. 2008-19028 discloses a configuration which includes a pressing member provided at a position near a reference fence and a control unit that changes at least one of the number of times and the duration for pressing sheets by using the pressing member for the purpose of preventing binding from failing.

However, even when the pressing member is arranged at a position near the reference fence, and at least one of the number of times and the duration for pressing the sheets by using the pressing member is changed similarly to the invention disclosed in Japanese Patent Application Laid-open No. 2008-19028, the pressing position is not changed in accordance with the sheet size or the binding position. Accordingly, there are cases where the pressing position and the binding position are separated from each other. In such cases, the bending as described above may occur, and it is difficult to sufficiently cope with the change in the pressing position or the sheet size.

Thus, there is a need to achieve high precision in aligning the sheet bundle regardless of the sheet size or the binding position.

SUMMARY OF THE INVENTION

It is an object of the present invention to at least partially solve the problems in the conventional technology.

A sheet processing apparatus includes: a stacking unit that stacks conveyed sheets; an aligning unit that aligns the sheets stacked on the stacking unit in a sheet conveying direction; a binding unit that moves along an end portion of a bundle of the sheets on a binding portion side and performs a binding process for the bundle of the sheets that have been aligned by the aligning unit; a pressing unit that presses the bundle of the sheets at the end portion thereof on the binding portion side; and an interlocking unit that moves the pressing unit in association with a motion of the binding unit.

An image forming system includes: a sheet processing apparatus that includes: a stacking unit that stacks conveyed sheets; an aligning unit that aligns the sheets stacked on the stacking unit in a sheet conveying direction; a binding unit that moves along an end portion of a bundle of the sheets on a binding portion side and performs a binding process for the bundle of the sheets that have been aligned by the aligning unit; a pressing unit that presses the bundle of the sheets at the end portion thereof on the binding portion side; and an interlocking unit that moves the pressing unit in association with a motion of the binding unit, and an image forming apparatus that conveys the sheets on which image formation has been performed to the sheet processing apparatus.

A sheet processing method includes: stacking conveyed sheets on a stacking unit; aligning the sheets stacked on the stacking unit in a sheet conveying direction by using an aligning unit; and moving a binding unit along an end portion on a binding portion side of a bundle of sheets, and causing the binding unit to perform a binding process for the bundle of the sheets that have been aligned by the aligning unit. The binding process is performed by the binding unit in a state in which a pressing unit that moves in association with movement of the binding unit presses the end portion on the binding portion side of the bundle of sheets.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to the embodiments, a binding process is performed constantly in a state in which a position located near a stapling position is pressed by a pressing member regardless of a sheet size or a difference in the sheet binding position by moving a pressing member connected with a binding unit.

Hereinafter, the embodiments will be described with reference to the drawings. In the description presented below, although units having the same configuration or the same function are denoted using the suffixes of letters a, b, . . . , the suffixes are not presented in a case where the units are collectively referred to.

First Embodiment

Figure 1:
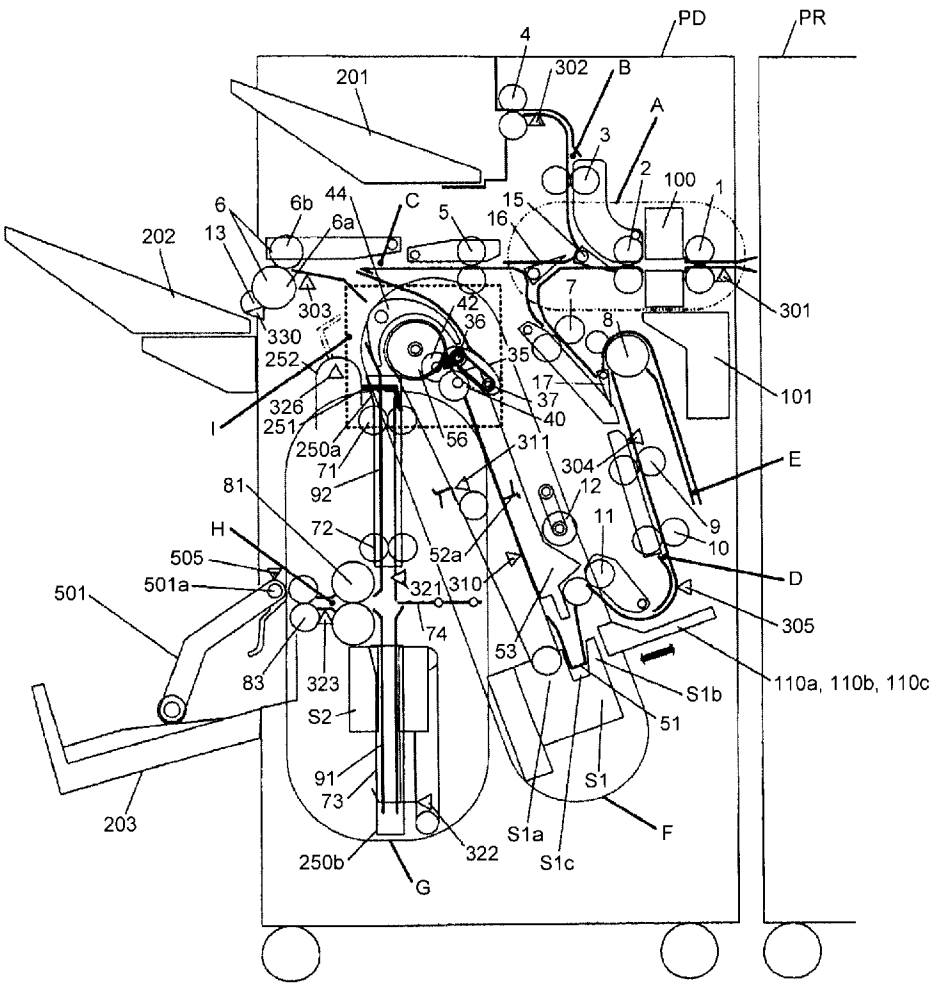
FIG. 1 is a system configuration diagram illustrating a system that is configured by a sheet post-processing apparatus as a sheet processing apparatus and an image forming apparatus according to a first embodiment.

FIG. 1 is a system configuration diagram illustrating a system that has a configuration including a sheet post-processing apparatus PD as a sheet processing apparatus according to a first embodiment and an image forming apparatus PR.

As illustrated in FIG. 1, the image forming apparatus PR at least includes an image processing circuit that converts input image data into printable image data; an optical writing device that performs optical writing operation on a photosensitive element based on an image signal output from the image processing circuit; a developing device that develops a latent image formed on the photosensitive element through the optical writing operation with toner; a transfer device that transfers a toner image developed by the developing device onto a sheet; and a fixing device that fixes the toner image transferred onto the sheet. The image forming apparatus PR sends out the sheet with the toner image fixed thereon to the sheet post-processing apparatus PD, in which desired post-processing is performed. Here, although the image forming apparatus PR is an electrophotographic type as described above, any known type of an image forming apparatus such as an ink jet type, a thermal transfer type, or the like can be used. In this embodiment, the image processing circuit, the optical writing device, the developing device, the transfer device, and the fixing device described above configure an image forming unit.

The sheet post-processing apparatus PD is attached to a side portion of the image forming apparatus PR, and a sheet discharged from the image forming apparatus PR is guided to the sheet post-processing apparatus PD. The sheet post-processing apparatus PD includes a conveying path A, a conveying path B, a conveying path C, a conveying path D, and a sheet-discharging conveying path H. The sheet is conveyed first to the conveying path A that includes a post-processing unit (in this embodiment, a punching unit 100 as a punching means) that performs post processing for one sheet.

Here, the conveying path B is a conveying path that guides a sheet to an upper tray 201 through the conveying path A. The conveying path C is a conveying path that guides a sheet to a sheet tray 202. In addition, the conveying path D is a conveying path that guides a sheet to a processing tray F (hereinafter, also referred to as an "end-face-binding processing tray") that performs alignment, staple binding, and the like. Branching of the sheet conveyance from the conveying path A to one of the conveying path B, the conveying path C, and the conveying path D is performed by a bifurcating claw 15 and a bifurcating claw 16.

This sheet post-processing apparatus can perform various processes on a sheet, such as punching (using the punching unit 100), sheet alignment plus end binding (using a jogger fence 53 and an end-face-binding stapler S1), sheet alignment plus center binding (using a center-binding upper-jogger fence 250*a*, a center-binding lower-jogger fence 250*b*, and a center-binding stapler S2), sheet sorting (using the sheet tray 202), center folding (using a folding plate 74 and a folding roller 81), and the like. Depending on the process to be performed, the conveying path A and one of the conveying paths B, C, and D following the conveying path A are selected. In addition, the conveying path D includes a sheet housing portion E. On the downstream side of the conveying path D, an end-face-binding processing tray F, a center-binding/center-folding tray G, and the sheet-discharging conveying path H are provided.

An entrance sensor 301 that detects a sheet received from the image forming apparatus PR is provided in the conveying path A that is common to the conveying path B, the conveying path C, and the conveying path D on the upstream thereof. In the conveying path A, an entrance roller 1, a punching unit 100, a punching waste hopper 101, a conveying roller 2, and the first and second bifurcating claws 15 and 16 are arranged on the downstream of the conveying path A in this order. The first and second bifurcating claws 15 and 16 are kept to be in a state (initial state) illustrated in FIG. 1 by springs (not illustrated), the bifurcating claws 15 and 16 are driven by turning on first and second solenoids (not illustrated), and a combination of the bifurcating directions of the first and second bifurcating claws 15 and 16 is changed by selecting turning on/off of the first and second solenoids, thereby branching sheets to one of the conveying path B, the conveying path C, and the conveying path D.

In a case where a sheet is guided to the conveying path B, the state illustrated in FIG. 1, that is, a state in which the first solenoid is turned off (the first claw 15 is turned down in the initial state thereof) is maintained. Accordingly, the sheet is conveyed by a conveying roller 3 and a discharging roller 4 and is discharged onto the upper tray 201.

In a case where a sheet is guided to the conveying path C, by turning on the first and second solenoids (the second bifurcating claw 16 is turned up in the initial state thereof) from the state illustrated in FIG. 1, a state is formed in which the bifurcating claw 15 is turned up, and the bifurcating claw 16 is turned down. Accordingly, the sheet is conveyed to the sheet tray 202 side through a conveying roller 5 and a sheet discharging roller pair 6 (6*a* and 6*b*). In this case, sorting of the sheet is to be performed. The sorting of the sheet is performed in the sheet tray discharging unit provided on the most downstream portion of the sheet post-processing apparatus PD by the sheet discharging roller pair 6 (6*a* and 6*b*), a returning roller 13, a sheet surface detecting sensor 330, a sheet tray 202, a shifting mechanism (not illustrated) that reciprocates the sheet tray 202 in a direction perpendicular to the sheet conveying direction, and a sheet tray lifting mechanism that lifts or lowers the sheet tray 202.

In a case where a sheet is guided to the conveying path D, by turning on the first solenoid that drives the first bifurcating claw 15 and turning off the second solenoid that drives the second bifurcating claw, the bifurcating claw 15 is turned up and the bifurcating claw 16 is turned down, and the sheet is conveyed by the conveying roller 2 and a conveying roller 7; thereby being guided to the conveying path D side. The sheets guided to the conveying path D are guided to the end-face-binding processing tray F. The sheets on which alignment, stapling, and the like are performed in the end-face-binding processing tray F are branched by a guide member 44 to the conveying path C guiding the sheets to the sheet tray 202 or the center-binding/center-folding tray G (hereinafter, also referred simply to as a "center-binding tray G) that performs folding and the like. In a case where a sheet bundle is guided to the sheet tray 202, the sheet bundle is discharged to the sheet tray 202 by the sheet discharging roller pair 6. By contrast, on a sheet bundle guided to the center binding tray G side, folding and binding are performed in the center binding tray G, and the sheet bundle is discharged by a discharging roller 83 onto a lower tray 203 through the sheet-discharging conveying path H.

On the other hand, a bifurcating claw 17 is provided in the conveying path D and is maintained in a state illustrated in the figure by a low-load spring (not illustrated) and, after the trailing end of a sheet conveyed by the conveying roller 7 passes through the bifurcating claw 17, the sheet can be reversed along a turn guide 8 by the reverse rotation of at least a conveying roller 9 out of conveying rollers 9 and 10 and a stapled-sheet discharging roller 11. Accordingly, the conveying path D is configured such that a sheet can be guided to the sheet receiving portion E from the trailing end of the sheet first, piled up (prestacked), and conveyed together with the next sheet in an overlapping manner therebetween. By repeating this operation, two or more sheets can be conveyed in a state in which one sheet overlaps another. Here, a prestack sensor 304 is used to set reverse conveying operational timing at the time of prestacking a sheet.

In a case where sheets are guided to the conveying path D so as to perform the alignment and the end binding thereof, the sheets guided to the end-face-binding processing tray F by the stapled-sheet discharging roller 11 are sequentially stacked onto the end-face-binding processing tray F. In such a case, for each sheet, alignment in the longitudinal direction (sheet conveying direction) is performed by a hitting roller 12, and alignment in the transverse direction (a direction perpendicular to the sheet conveying direction; also referred to as a sheet width direction) is performed by the jogger fence 53. During an interval between successive jobs, that is, the interval between the last sheet of a sheet bundle and the first sheet of the next sheet bundle, the end-face-binding stapler S1 serving as a binding unit is driven in accordance with a staple signal transmitted from a control device (not illustrated), so that a binding process is performed. The sheet bundle for which the binding process has been performed is immediately conveyed to the sheet discharging roller pair 6 by a discharging belt 52 (see FIG. 2) on which a discharging claw 52*a* is provided to protrude and is discharged onto the sheet tray 202 that is set at a reception position.

In addition, the end-face-binding stapler S1, as illustrated in FIG. 1, is configured by including a stitcher (driver) S1*a* that drives a staple and a clincher S1*b* that bends the ends of the staple. By configuring a space between the stitcher S1*a* and the clincher S1*b* as a space portion S1*c* through which first and second trailing-end reference fences 51*a* and 51*b* can pass, the end-face-binding stapler S1 is moved without causing any interference between the end-face-binding stapler S1 and the trailing-end reference fence 51. In addition, differently from the center binding stapler S2, the stitcher S1*a* and the clincher S1*b* are integrally formed in the end-face-binding stapler S1. The stitcher S1*a* functions as a fixed portion that is not moved in a direction perpendicular to the sheet face and the clincher S1*b* functions as a moving portion that moves in a direction perpendicular to the sheet face. Accordingly, in a case where the binding operation is performed on the sheet bundle SB, a predetermined bound portion of the sheet bundle SB that is abutting on stack faces 51*a*1 and 51*b*1 of the first and second trailing-end reference fences 51*a* and 51*b*, respectively, is moved toward the stitcher S1*a* by the clincher S1*b*, and the binding operation is performed in the process thereof.

Figure 2:
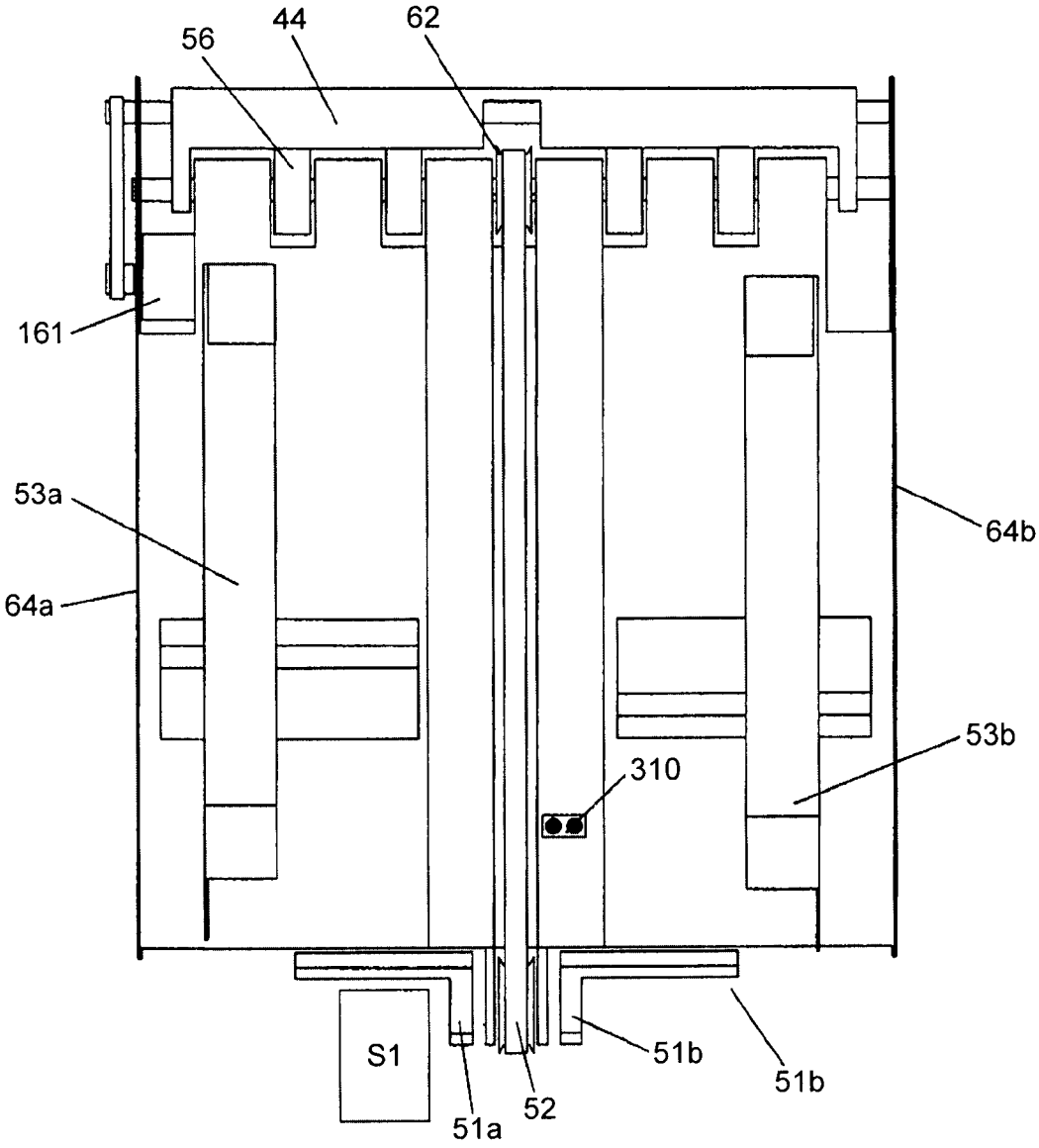
FIG. 2 is a schematic configuration diagram illustrating an end-face-binding processing tray illustrated in FIG. 1, viewed from the stacking face side of the tray.
Figure 4:
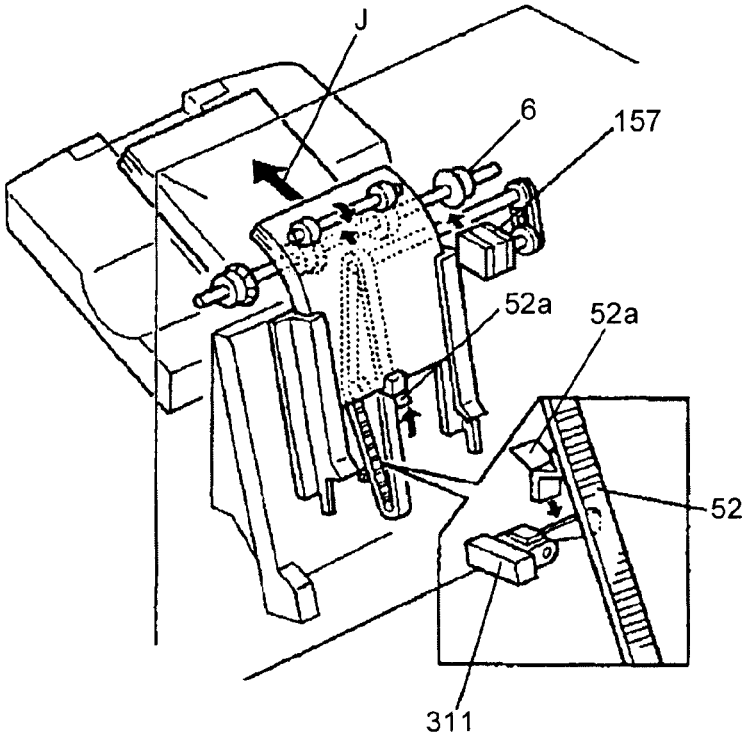
FIG. 4 is a side view illustrating the operation of a discharging belt illustrated in FIG. 1.

The discharging belt 52, as illustrated in FIGS. 2 and 4, is located at the alignment center in the sheet width direction, suspended between pulleys 62, and driven by a discharging-belt driving motor 157. In addition, a plurality of discharging rollers 56 is arranged in a symmetric manner with respect to the discharging belt 52 so as to be rotatable about a driving shaft, and functions as the plurality of driven rollers. FIG. 4 is a side view illustrating the operation of the discharging belt in FIG. 1, and the direction indicated by the arrow J is the sheet conveying direction.

A discharging-belt HP sensor 311 is disposed so as to detect the home position of the discharging claw 52*a*, and the discharging-belt HP sensor 311 is turned on and off by the discharging claw 52*a* disposed on the discharging belt 52. On the outer circumference of the discharging belt 52, two discharging claws 52*a* are arranged at positions facing each other so as to alternately move and convey sheet bundles housed in the end-face-binding processing tray F. In addition, the leading edge in the conveying direction of a sheet bundle housed in the end-face-binding processing tray F may be aligned with the back face of the discharging claw 52*a* located on the side opposite to the discharging claw 52*a* that is in the standby state for moving a sheet bundle by reversely rotating the discharging belt 52 as necessary.

Figure 7:
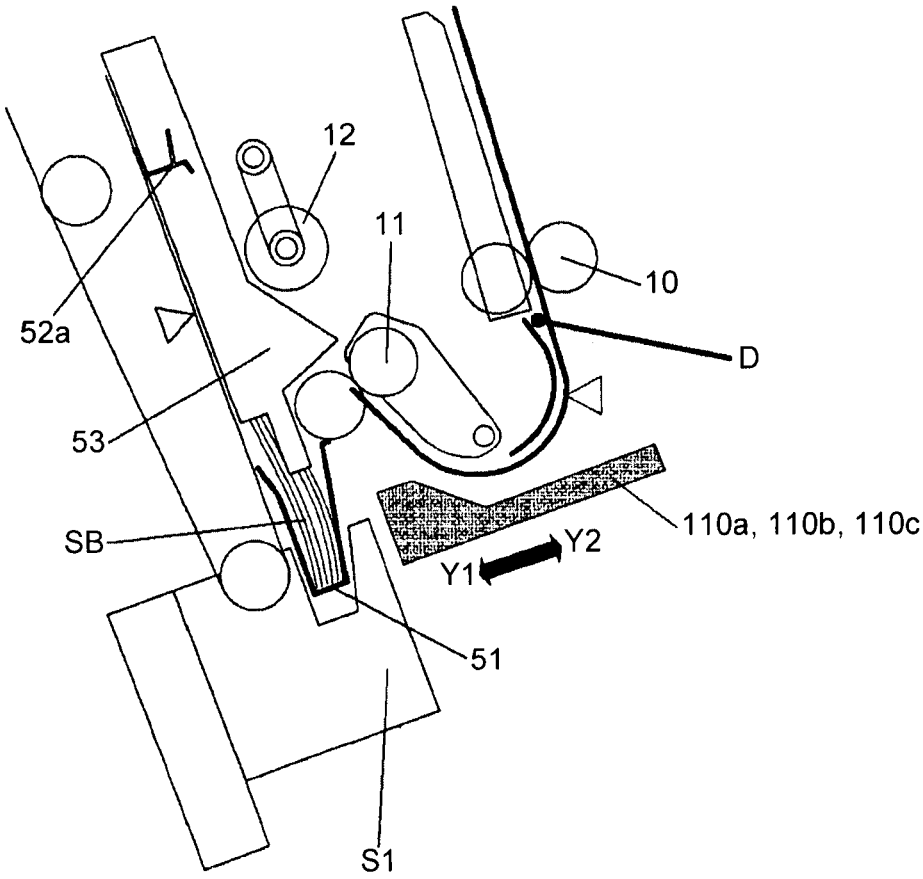
FIG. 7 is a front view of a relevant portion that illustrates a schematic configuration of a lower portion of the end-face-binding processing tray F.

In FIG. 1, pressing members (trailing-end pressing levers) 110*a*, 110*b*, and 110*c* are disposed in a lower end portion of the trailing-end reference fence 51 so as to press the trailing end of the sheet bundle SB housed in the trailing-end reference fence 51 and reciprocate in a direction that is approximately perpendicular to the end-face-binding processing tray F (the directions indicated by the arrows Y1 and Y2 illustrated in FIG. 7). While the sheets discharged to the end-face-binding processing tray F are aligned in the longitudinal direction (the sheet conveying direction) by the hitting roller 12 for each of the sheets, in a case where the trailing ends of the sheets stacked on the end-face-binding processing tray F are curled or have low stiffness, the trailing ends tend to be buckled and bulged due to the weight thereof. In addition, as the number of stacked sheets increases, the trailing-end reference fence 51 loses a clearance space into which the next sheet can be inserted, so that the alignment in the longitudinal direction tends to deteriorate. Thus, there is provided a pressing mechanism that allows the sheets to be easily inserted into the trailing-end reference fence 51 by decreasing the bulge of the sheet trailing end. That is the pressing mechanism presses the trailing end of the sheets. Further, there are provided pressing members 110*a*, 110*b*, and 110*c* that directly press sheets or a sheet bundle. The pressing member is also called a pressing lever.

In FIG. 1, sheet detecting sensors 302, 303, 304, 305, and 310 respectively detect whether or not a sheet passes at positions where the sheet detecting sensors 302, 303, 304, 305, and 310 are provided or whether or not a sheet is conveyed.

FIG. 2 is a schematic configuration diagram of the end-face-binding processing tray F viewed from the stacking face side thereof and corresponds to a right side view of the end-face-binding processing tray F in FIG. 1. In FIG. 2, the sheets are received from the image forming apparatus PR provided on the upstream side in the sheet conveying direction, and the alignment of the sheets in the width direction is performed by jogger fences 53*a* and 53*b*, and the alignment of the sheets in the longitudinal direction is achieved by abutting on the sheets onto the first and second trailing-end reference fences 51*a* and 51*b* (denoted by reference numeral 51 in FIG. 1).

Figure 3:
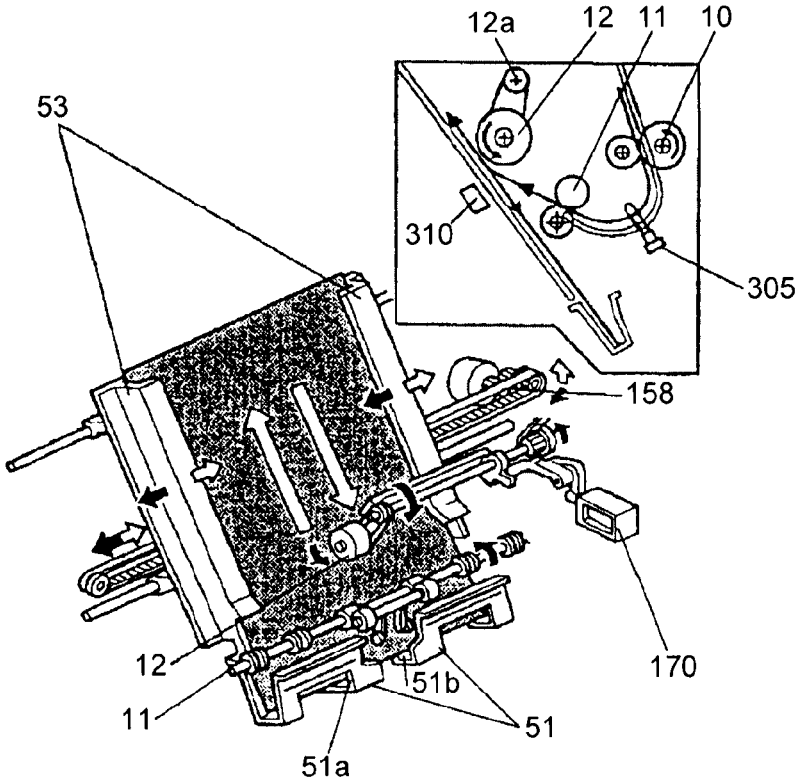
FIG. 3 is a perspective view illustrating a schematic configuration of the end-face-binding processing tray illustrated in FIG. 1 and mechanisms attached thereto.

FIG. 3 is a perspective view illustrating a schematic configuration of the end-face-binding processing tray F and the mechanisms attached thereto. As illustrated in FIG. 3, sheets guided to the end-face-binding processing tray F by the stapled-sheet discharging roller 11 are sequentially stacked onto the end-face-binding processing tray F. At this time, when the number of sheets discharged onto the end-face-binding processing tray F is one, the alignment of that sheet in the longitudinal direction (sheet conveying direction) is performed by the hitting roller 12, and the alignment of the sheet in the width direction (a sheet width direction perpendicular to the sheet conveying direction) is performed by the jogger fences 53*a* and 53*b*. The hitting roller 12 is caused by a hitting SOL 170 to perform a pendulum motion about a fulcrum 12*a* and intermittently acts on the sheet fed onto the end-face-binding processing tray F, so that the trailing end ST of the sheet abuts on the trailing-end reference fence 51. Meanwhile, the hitting roller 12 is configured to rotate in the counterclockwise direction. As illustrated in FIGS. 2 and 3, a pair of the jogger fences 53 including front and rear jogger fences 53*a* and 53*b* is provided and is driven through a timing belt to reciprocate in the sheet width direction by a jogger motor 158 that is rotatable in the forward and reverse directions.

Figure 5:
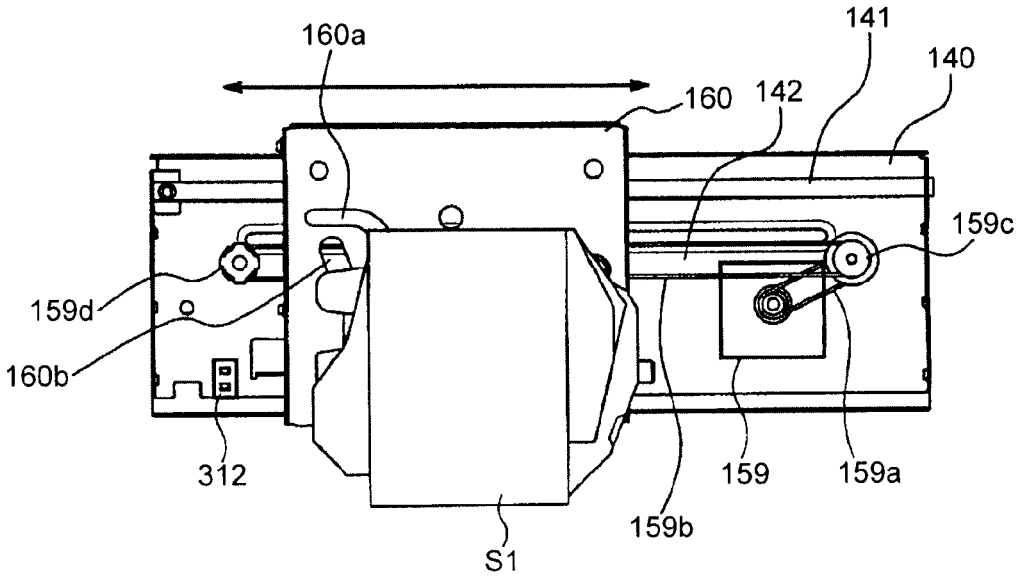
FIG. 5 is a perspective view illustrating a moving mechanism of a stapler illustrated in FIG. 1.

FIG. 5 is a side view illustrating a stapler moving mechanism. As illustrated in FIG. 5, the end-face-binding stapler S1 is supported to be slidable in the sheet width direction by a sliding shaft 141 that is supported between side plates provided on both sides of a support plate 140 and by a sliding groove 142 that is formed in the support plate 140 so as to be parallel to the sliding shaft 141. On the other hand, a timing belt 159*b* is stretched between pulleys 159*c* and 159*d* so as to be parallel to the sliding shaft 141, and the timing belt 159*b* is driven by a stapler moving motor 159 that is rotatable in the forward and reverse directions through the timing belt 159*a*. Because the end-face-binding stapler S1 is attached to the timing belt 159*b*, the rotational driving force of the stapler moving motor 159 is transferred to the end-face-binding stapler 51, and the end-face-binding stapler S1 is moved in the sheet width direction along the sliding shaft 141 and the sliding groove 142 so as to bind a predetermined position of the sheet near the trailing end of the sheet.

At an end of the moving range of the end-face-binding stapler S1, a stapler moving HP sensor 312 that detects the home position thereof is disposed, and the binding position in the sheet width direction is controlled based on the moving amount of the end-face-binding stapler S1 from the home position. The end-face-binding stapler S1 is configured to be capable of binding sheets at one or a plurality of positions (generally, at two positions) in the sheet trailing end portion, and to be movable over an entire width of the sheet trailing end ST that is supported at least by the trailing-end reference fences 51*a* and 51*b*. In addition, for the replacement of the staple, the end-face-binding stapler S1 is configured to be maximally movable to the front side of the apparatus so as to maintain the utility in the replacing operation of staples by a user.

Figure 6:
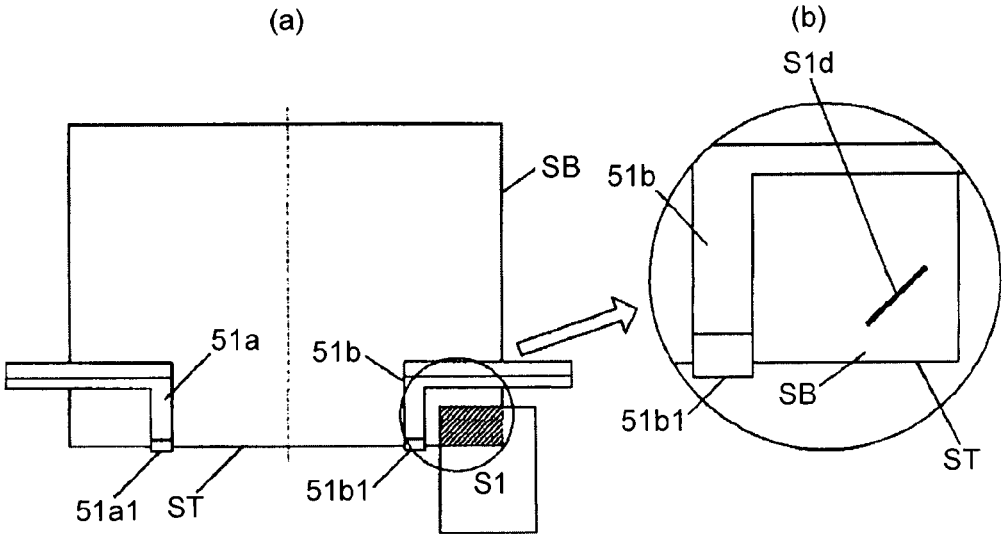
FIG. 6 is a diagram illustrating the relation between sheets stacked on the end-face-binding processing tray, trailing end reference fences, and an end-face-binding stapler when the end-face-binding is performed.

FIG. 6 is a diagram illustrating the relation among a sheet bundle SB stacked on the end-face-binding processing tray F, the trailing-end reference fence 51, and the end-face-binding stapler S1 when the end face binding is performed. As can be understood from FIG. 6, the first and second trailing-end reference fences 51*a* and 51*b* respectively include stack faces 51*a*1 and 51*b*1 on which the sheet trailing end ST abuts on the inner sides thereof so as to support the sheet at the sheet trailing end ST, thereby to support the whole sheet bundle SB. Conventionally, four-point support has been generally employed; however, in this embodiment, two-point support is employed, and the position of the sheet trailing end ST is defined at two points. In addition, although FIG. 6(*a*) illustrates one-point binding near an end face, in the case of one-point tilted binding, in the end-face-binding stapler S1, the main body of the end-face-binding stapler S1 is rotated around an end portion of the sheet on the side of the sheet trailing end ST as illustrated in FIG. 6(*b*), and the binding process is performed in a state in which the staple S1*s* is tilted at an angle from the one-point binding position near the end face in FIG. 6(*a*).

As illustrated in FIG. 6(*a*), the sheet bundle SB is stacked by being in contact with two points of the stack faces 51*a*1 and 51*b*1 of the trailing-end reference fence 51. Then, a binding process is performed by the stapler S1. FIG. 6(*b*) is a diagram illustrating the relation between the staple S1*d* and the trailing-end reference fence 51*b* after the tilted binding is performed. After the aligning operation is completed, the binding process is performed by the end-face-binding stapler S1, and, as can be understood from the perspective view of FIG. 4 illustrating the operation of the discharging belt 52, the discharging belt 52 is driven in the counterclockwise direction by the discharging-belt driving motor 157, and the sheet bundle after the binding process is picked up by the discharging claw 52*a* attached to the discharging belt 52 and is moved out of the end-face-binding processing tray F. Here, reference numerals 64*a* and 64*b* denote a front side plate and a rear side plate. In addition, this operation can be similarly performed on an unbound sheet bundle for which the binding process has not been performed after the alignment process.

FIG. 7 is a front view of a relevant portion that illustrates a schematic configuration of a lower portion of the end-face-binding processing tray F. In the lower portion of the end-face-binding processing tray F, the trailing-end reference fence 51, the end-face-binding stapler S1, and the stapled-sheet discharging roller 11 are disposed, and the pressing member 110 is disposed on a side that faces the trailing-end reference fence 51. The pressing member 110 that has been described already is used to press the trailing end of the sheet bundle SB housed on the trailing-end reference fence 51, and is therefore provided in the lower end portion of the trailing-end reference fence 51. Moreover, the pressing member 110 is configured so as to reciprocate in the directions (indicated by the arrows Y1 and Y2) approximately perpendicular to the end-face-binding processing tray F. A plurality (in this embodiment, three) of the pressing members 110 are provided in the sheet width direction. The pressing members 110*a*, 110*b*, and 110*c* move in the sheet width direction in association with the end-face-binding stapler S1 by a mechanism to be described later, can move to be close to or to be separated from the sheet bundle, presses the trailing end of the sheet bundle with predetermined pressure, and hold the sheet bundle SB between the trailing-end reference fence 51 and the pressing members, respectively, when the binding process is performed.

On the downstream side of the end-face-binding processing tray F in the sheet conveying direction, a sheet bundle deflecting mechanism I is provided. As illustrated in FIG. 1, a conveying path that conveys a sheet bundle SB from the end-face-binding processing tray F to the center binding tray G and from the end-face-binding processing tray F to the sheet tray 202 and a conveying unit thereof are configured to include a conveying mechanism 35 that applies a conveying force to the sheet bundle SB, a discharging roller 56 that turns the sheet bundle SB, and a guide member 44 that guides the sheet bundle SB to be turned.

More specifically, a roller 36 of the conveying mechanism 35 and a driving shaft 37 are configured such that the driving force of the driving shaft 37 is transferred to the roller 36 of the conveying mechanism 35 through a timing belt; the roller 36 and the driving shaft 37 are supported and connected by an arm in such a manner that the roller 36 can oscillate about the driving shaft 37 serving as a rotation fulcrum. The roller 36 of the conveying mechanism 35 is driven to oscillate by a cam 40, and the cam 40 is configured to rotate about the rotating shaft and is driven by a motor (not illustrated). In the conveying mechanism 35, a driven roller 42 is provided at a position that faces the roller 36. A sheet bundle is interposed between the driven roller 42 and the roller 36 and is pressed by an elastic member so as to apply the conveying force thereto.

A conveying path used for turning the sheet bundle from the end-face-binding processing tray F to the center binding tray G is formed between the discharging roller 56 and an inner face of the guide member 44 that is provided on a side to face the discharging roller 56. The guide member 44 is turned about a fulcrum, and the driving force thereof is transmitted from a bundle bifurcating driving motor 161 (see FIG. 2). In a case where a sheet bundle is conveyed from the end-face-binding processing tray F to the sheet tray 202, the guide member 44 is turned about the fulcrum in the clockwise direction in the drawing, and a space between the outer face (a face not facing the discharging roller 56) of the guide member 44 and a guide plate provided on the outer side thereof serves as a conveying path. In a case where a sheet bundle P is conveyed from the end-face-binding processing tray F to the center binding tray G, the trailing end of the sheet bundle SB aligned by the end-face-binding processing tray F is lifted by the discharging claw 52*a*, and the sheet bundle is interposed between the roller 36 of the conveying mechanism 35 and the driven roller 42 that faces the roller 36, and is provided with a conveying force. At this time, the roller 36 of the conveying mechanism 35 is on standby at a position to avoid hitting the leading edge of the sheet bundle SB. Next, after the leading edge of the sheet bundle SB passes through the conveying mechanism 35, the roller 36 of the conveying mechanism 35 is brought into contact with the sheet surface of the sheet bundle so as to apply the conveying force to the sheet bundle.

At this time, a guide for the turning-conveying path is formed by the guide member 44 and the discharging roller 56, and the sheet bundle SB is conveyed to the center binding tray G provided on the downstream in the sheet conveying direction.

The center binding tray G is provided on the downstream side of the sheet bundle deflecting mechanism in the sheet conveying direction as illustrated in FIG. 1. Here, the sheet bundle deflecting mechanism is formed by the conveying mechanism 35, the guide member 44, and the discharging roller 56. The center binding tray G is disposed approximately vertically on the downstream side of a sheet bundle deflecting mechanism in the sheet conveying direction; a center folding mechanism is arranged in the center portion thereof; an upper sheet-bundle conveying guide plate 92 is arranged on the upper side thereof; and a lower sheet-bundle conveying guide plate 91 is arranged on the lower side thereof.

In addition, an upper sheet-bundle conveying roller 71 is provided in the upper portion of the upper sheet-bundle conveying guide plate 92, a lower sheet-bundle conveying roller 72 is provided in the lower portion thereof, and a center binding upper jogger fences 250*a* are provided on both sides of the upper sheet-bundle conveying guide plate 92 along the side face thereof so as to straddle both of the rollers 71 and 72. Similarly, center binding lower jogger fences 250*b* are provided on both sides of the lower sheet-bundle conveying guide plate 91 along the side face thereof, and a center binding stapler S2 is provided at a position where the center binding lower jogger fences 250*b* are provided. The center binding upper jogger fences 250*a* and the center binding lower jogger fences 250*b* are driven by a driving mechanism (not illustrated), and perform an alignment operation in the direction (the sheet width direction) perpendicular to the sheet conveying direction. The center binding stapler S2 is formed by a clincher portion and a driver portion that make a pair, and two center binding staplers S2 are provided with a predetermined interval interposed therebetween in the sheet width direction.

In addition, a movable trailing end reference fence 73 is provided to traverse the lower sheet-bundle conveying guide plate 91, and a sheet bundle can be moved in the sheet conveying direction (the vertical direction in the figure) by a moving mechanism that includes a timing belt and a driving mechanism thereof. The driving mechanism, as illustrated in FIG. 1, is configured by a driving pulley and a driven pulley over which the timing belt is suspended and a stepping motor that drives the driving pulley. Similarly, on the upper end side of the upper sheet-bundle conveying guide plate 92, a trailing-end hitting claw 251 and a driving mechanism thereof are provided. The trailing-end hitting claw 251 can reciprocate in a direction separating from the sheet bundle deflecting mechanism and a direction to push the rear end (a side corresponding to the rear side at the time of introducing a sheet bundle) of a sheet bundle by using a timing belt 252 and a driving mechanism (not illustrated).

A center folding mechanism is provided at an approximate center portion of the center binding tray G, and is configured by a folding plate 74, a folding roller 81, and a conveying path H used for conveying a folded sheet bundle. In FIG. 1, a home position sensor 326 detects the home position of the trailing end hitting claw 251, a folding portion passage sensor 323 detects a center-folded sheet, a bundle detecting sensor 321 detects the arrival of a sheet bundle at the center folding position, and a movable trailing-end reference-fence home-position sensor 322 detects the home position of the movable trailing-end reference fence 73.

In addition, in this embodiment, a detection lever 501 that detects the stacked height of a center-folded sheet bundle SB is provided in the lower tray 203 in a freely swingable manner about a fulcrum 501*a*, and the lifting/lowering operation of the lower tray 203 and the detection of overflow thereof are performed by detecting the angle of the detection lever 501 by using a sheet face sensor 505.

Figure 8:
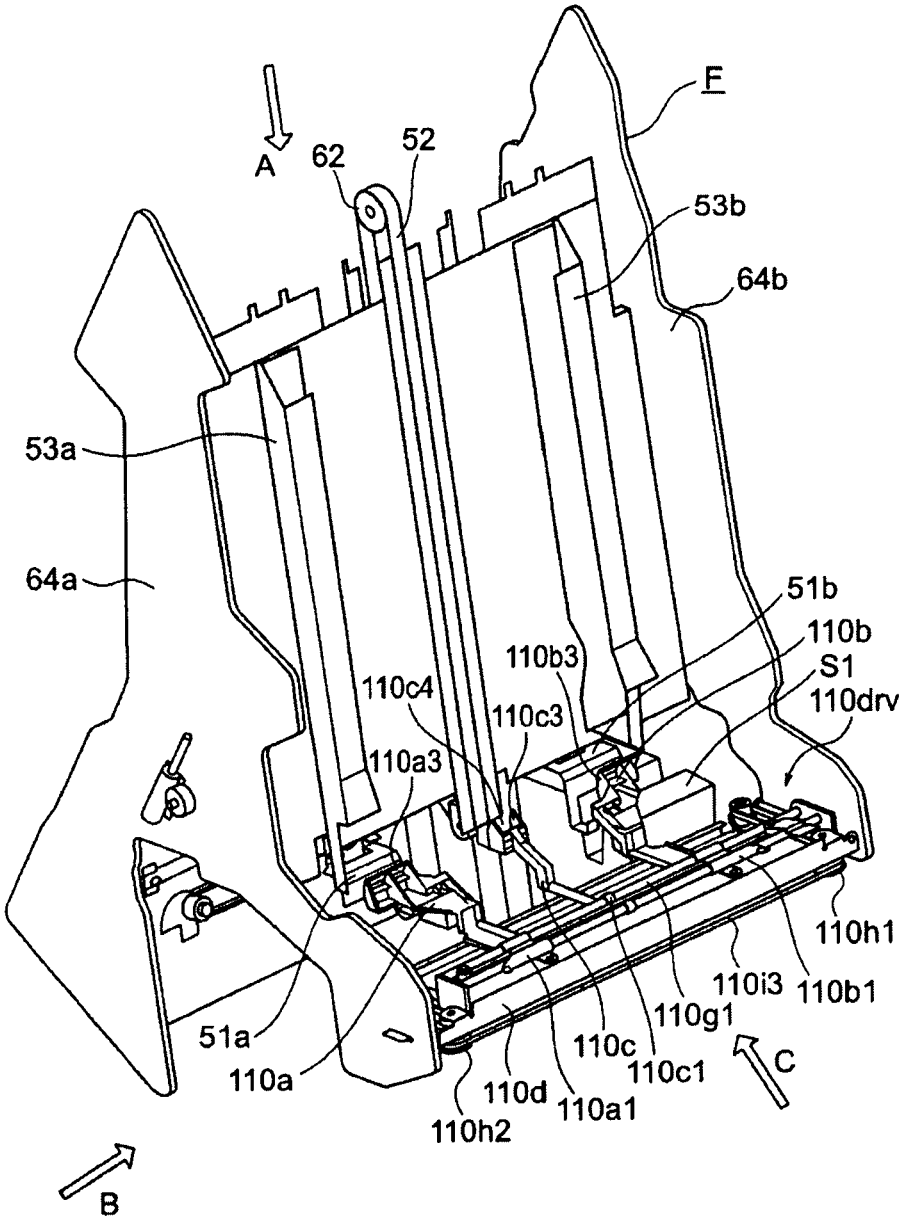
FIG. 8 is a detailed perspective view illustrating the relation among the end-face-binding processing tray, the trailing end reference fences, and a pressing member illustrated in FIGS. 2 and 3.
Figure 9:
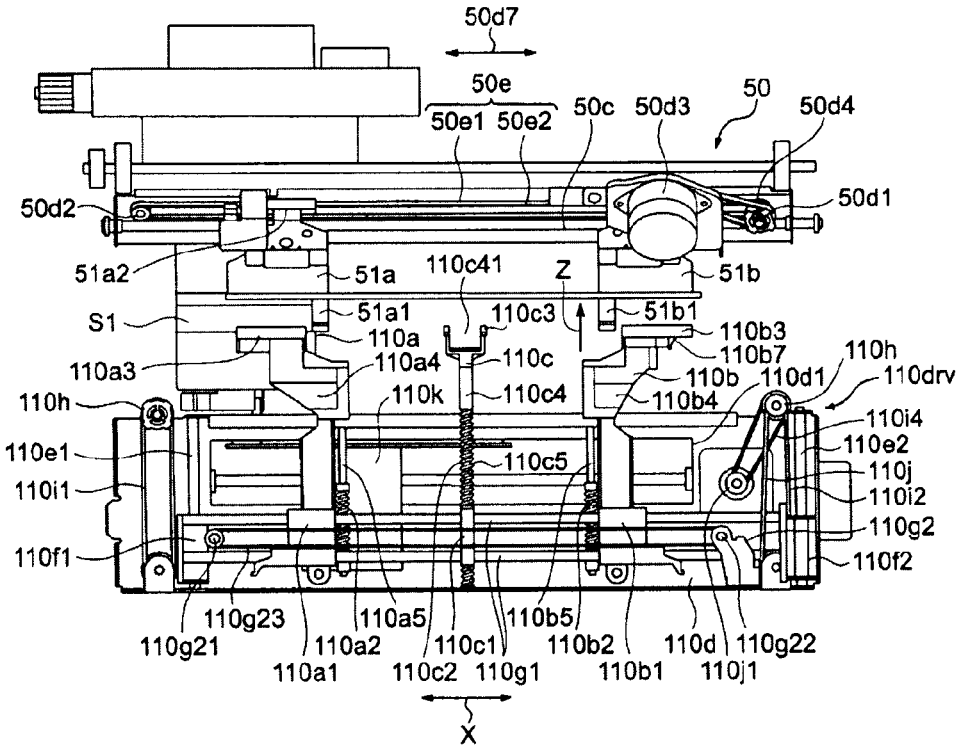
FIG. 9 is a diagram illustrating a state in which a sheet bundle is not pressed, viewed from the direction indicated by the arrow A illustrated in FIG. 8.
Figure 10:
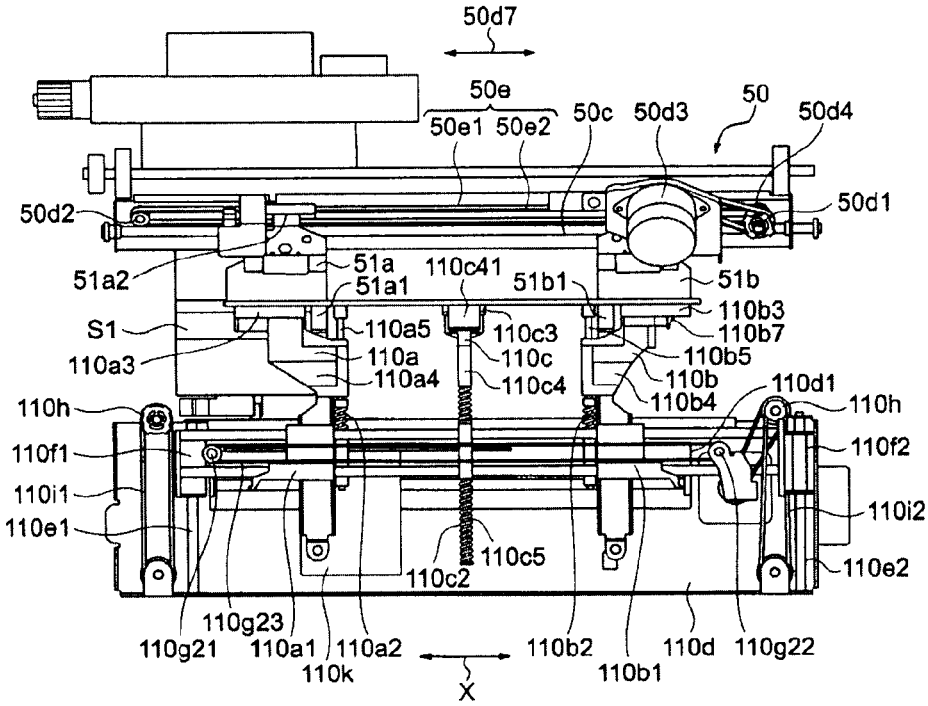
FIG. 10 is a diagram illustrating a state in which the sheet bundle is pressed, viewed from the direction indicated by the arrow A illustrated in FIG. 8.
Figure 11:
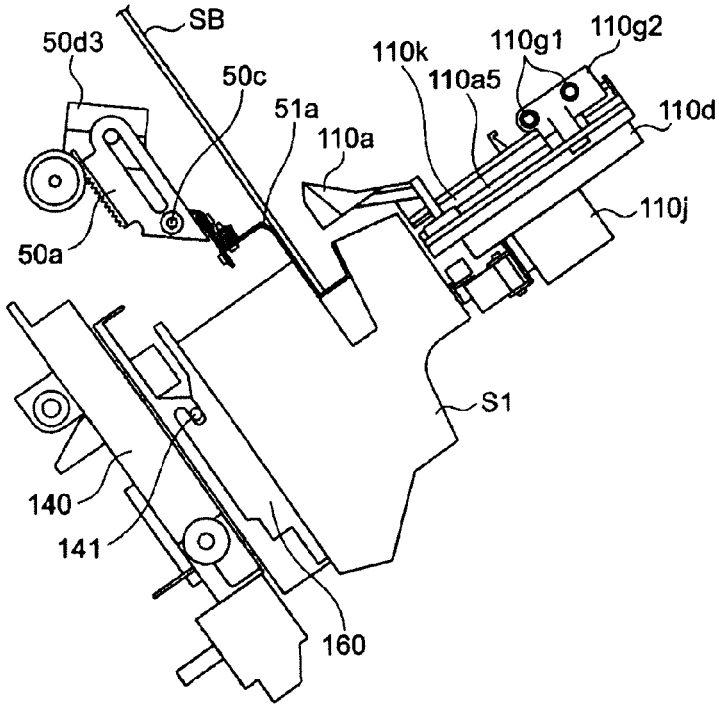
FIG. 11 is a diagram illustrating a state in which the sheet bundle is not pressed, viewed from the direction indicated by the arrow B illustrated in FIG. 8.
Figure 12:
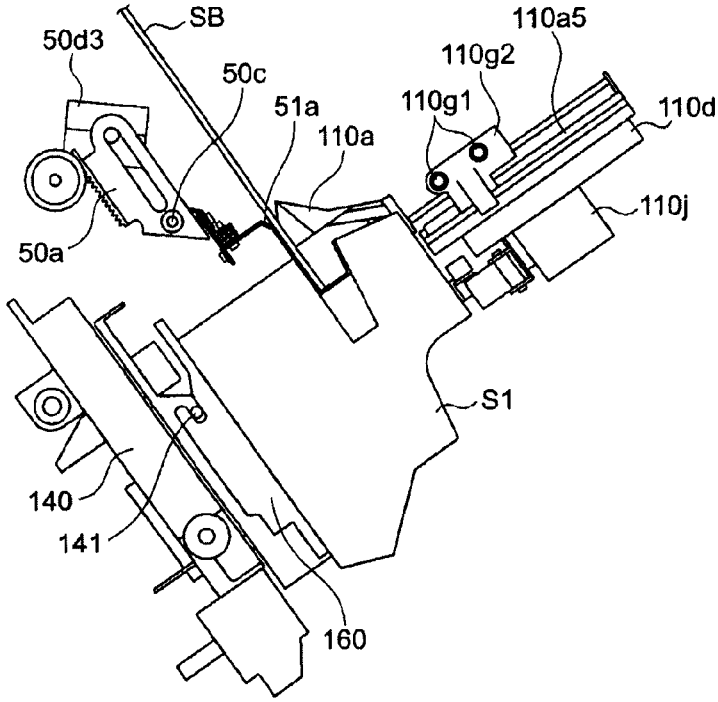
FIG. 12 is a diagram illustrating a state in which the sheet bundle is pressed, viewed from the direction indicated by the arrow B illustrated in FIG. 8.
Figure 13:
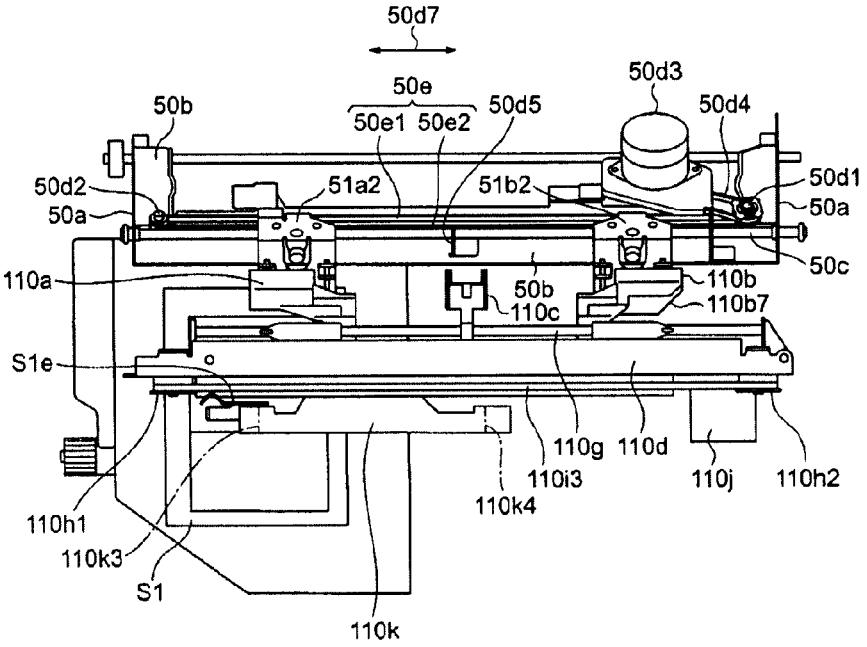
FIG. 13 is a diagram illustrating the trailing end reference fences and the pressing member viewed from the direction indicated by the arrow C illustrated in FIG. 8.
Figure 14:
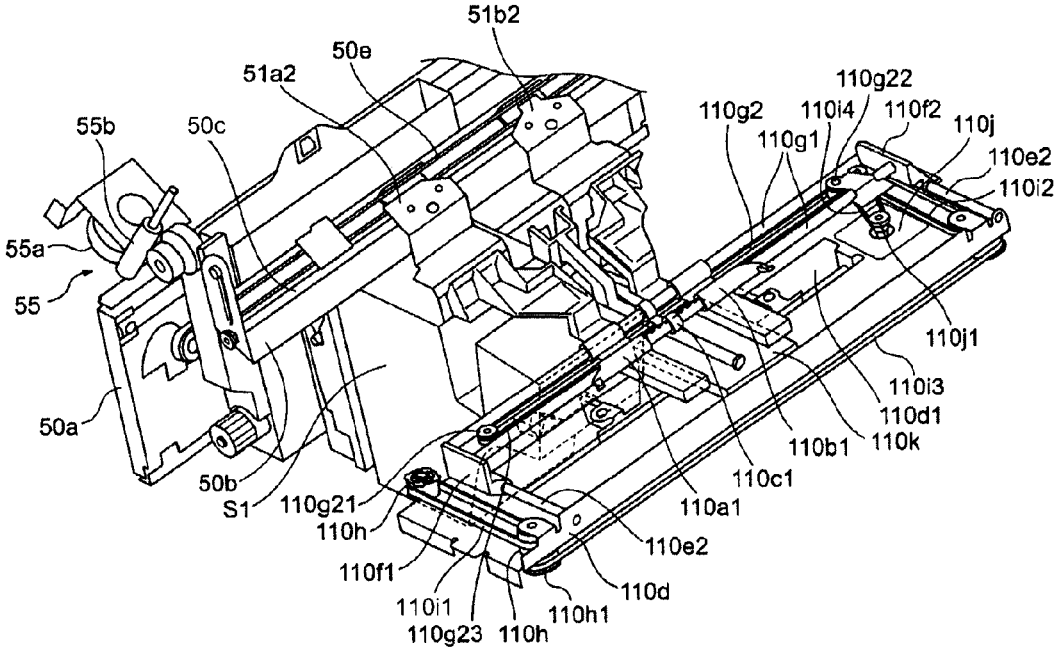
FIG. 14 is a perspective view illustrating relevant portions of the end-face-binding processing tray, the trailing end reference fences, and the pressing member.

FIG. 8 is a detailed perspective view illustrating the relation among the end-face-binding processing tray F, the trailing-end reference fences 51*a* and 51*b*, and the pressing member 110 illustrated in FIGS. 2 and 3. FIG. 9 is a diagram illustrating a state in which a sheet bundle is not pressed, viewed from the direction indicated by the arrow A illustrated in FIG. 8. FIG. 10 is a diagram illustrating a state in which the sheet bundle is pressed, viewed from the direction indicated by the arrow A illustrated in FIG. 8. FIG. 11 is a diagram illustrating a state in which the sheet bundle is not pressed, taken along arrow B illustrated in FIG. 8. FIG. 12 is a diagram illustrating a state in which the sheet bundle is pressed, viewed from the direction indicated by the arrow B illustrated in FIG. 8. FIG. 13 is a diagram illustrating the trailing end reference fences and the pressing member viewed from the direction indicated by the arrow C illustrated in FIG. 8. FIG. 14 is a perspective view illustrating the relevant portions of the end-face-binding processing tray F, the trailing-end reference fences 51*a* and 51*b*, and the pressing member 110. Here, the diagram viewed from the direction indicated by the arrow A is a diagram obtained by viewing the end-face-binding processing tray F from above in parallel with the sheet face with the trailing ends supported by the trailing-end reference fences 51*a* and 51*b*, the diagram viewed from the direction indicated by the arrow B is a diagram obtained by viewing the end-face-binding processing tray F from the left side in parallel with the sheet face with the trailing ends supported by the trailing-end reference fences 51*a* and 51*b*, and the diagram viewed from the direction indicated by the arrow C is a front view of the end-face-binding processing tray F.

As can be understood from these figures, in a lower portion of the end-face-binding processing tray F, a pair of trailing-end reference fences 51*a* and 51*b* is disposed, first and second pressing members 110*a* and 110*b* are disposed at positions facing the trailing-end reference fences 51*a* and 51*b*, respectively, and a third pressing member 110*c* is provided between the first and second pressing members 110*a* and 110*b* at a position facing the discharging belt 52. The three pressing members 110*a*, 110*b*, and 110*c* are supported by a support member 110*d* so as to be movable in a direction perpendicular to the sheet face of the sheet bundle SB and a direction parallel to the sheet face thereof, and can reciprocate in a direction perpendicular to the sheet face of the sheet bundle SB by a pressing member driving mechanism 110*drv*.

The pressing member driving mechanism 110*drv* is configured by the following mechanisms mounted on the support member 110*d*.

A pair of first guide shafts 110*e*1 and 110*e*2 extending in a direction perpendicular to the sheet face are provided on both ends of the support member 110*d*, and first and second sliders 110*f*1 and 110*f*2 are mounted to the guide shafts 110*e*1 and 110*e*2 in a slidable manner. Between the first and second sliders 110*f*1 and 110*f*2, two second guide shafts 110*g*1 and a slide base 110*g*2 are provided. In the second guide shaft 110*g*1, a first slider portion 110*a*1 and a second slider portion 110*b*1, which are slider portions of the first and second pressing members 110*a* and 110*b*, are mounted in a slidable manner, and a slider portion 110*c*1 of the third pressing member 110*c* is fixed to the center portion of the second guide shaft 110*g*1. In addition, on the slide base 110*g*2, first and second pulleys 110g21 and 110g22 are mounted, and a timing belt 110g23 is stretched therebetween.

Figure 17:
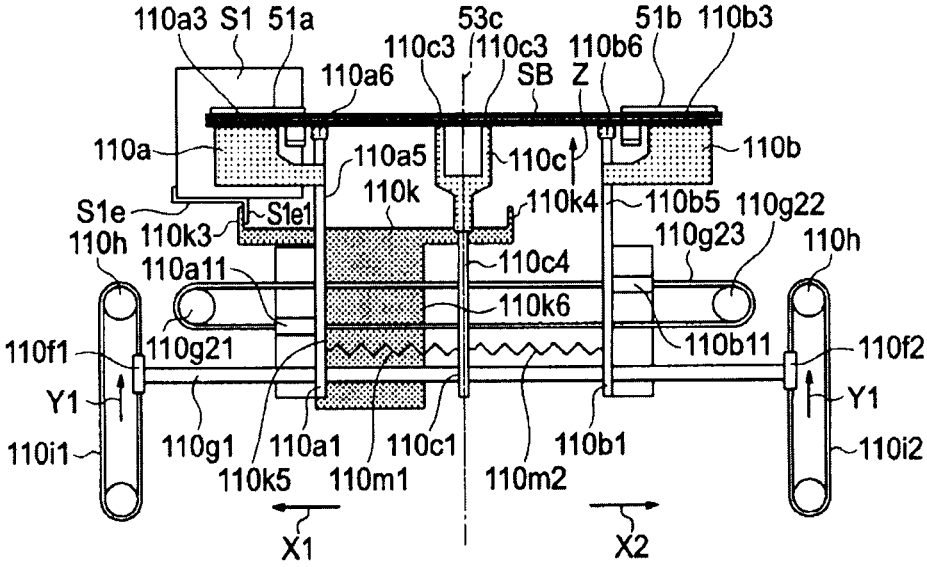
FIG. 17 is an operation explanatory diagram illustrating the relation between the end-face-binding stapler, first to third pressing members, and the trailing end reference fences at the time of performing front binding.

In addition, as illustrated in FIG. 17, connection portions 110a11 and 110b11 of the first slider portion 110a1 and the second slider portion 110b1 are connected to positions, which are provided on one side and the other side of the timing belt 110g23 in a symmetric way with respect to the slider portion 110c1 of the third pressing member 110c. Furthermore, as illustrated in FIG. 17, elastic members (for example, tensile coil springs) 110m1 and 110m2 are provided between the first and third pressing members 110a and 110c, and between the second and third pressing members 110b and 110c, respectively, in such a way that the elastic member 110m1 constantly urges to move the first and third pressing members 110a and 110c in the directions to be close to each other and the elastic member 110m2 constantly urges to move the second and third pressing members 110b and 110c in the directions to be close to each other. Therefore, in accordance with the rotation of the timing belt 110g23, the first and second pressing members 110a and 110b move close to or separated from each other in a symmetric way by interposing the third pressing member 110c therebetween.

On the side portions of the first and second sliders 110f1 and 110f2, pulleys 110h are respectively provided. First and second timing belts 110i1 and 110i2 are stretched between the pulleys 110h that makes a pair, in parallel with the first and second sliders 110f1 and 110f2. On the driving shaft of the pulley 110h arranged on a side of the support member 110d that is away from the side where the trailing-end reference fence 51 is disposed, other pulleys 110h1 and 110h2 are coaxially provided. A third timing belt 110i3 is stretched between the pulleys 110h1 and 110h2 in parallel with the second guide shaft 110g (see FIG. 13). In addition, on the arrangement side of the second slider 110f2, a driving motor 110j is provided to drive one of the pulleys 110h arranged on the arrangement side. A driving force is transferred by a fourth timing belt 110i4 stretched between a driving pulley 110j1 of the driving motor 110j and the one of the pulleys 110h. Accordingly, the driving force of the driving motor 110j is transferred from the fourth timing belt 110i4 to the first and second sliders 110f1 and 110f2, the first and second sliders 110f1 and 110f2 can reciprocate in a direction perpendicular to the sheet face, and, in the state in which the first and second pressing members 110a and 110b are movable in the width direction (a direction perpendicular to the sheet conveying direction) of the sheet face, a pressing operation or a separation operation of the first to third pressing members 110a, 110b, and 110c for the sheet bundle SB can be performed in accordance with the reciprocation.

The first to third pressing members 110a, 110b, and 110c are supported by the slider portions 110a1, 110b1, and 110c1 in a state in which the first to third pressing members 110a, 110b, and 110c are elastically urged in a direction to constantly pressing the sheet face by elastic members (for example, tensile coil springs) 110a2, 110b2, and 110c2. FIG. 9 illustrates an initial state without a load, and FIG. 10 illustrates a loaded state in which a sheet bundle SB is pressed. In the unloaded condition, the first and second sliders 110f1 and 110f2 retreat from the sheet face so as to be maximally separated therefrom, and, in the loaded state, the first and second sliders 110f1 and 110f2 maximally advance, and the elastic members 110a2, 110b2, and 110c2 are compressed. In a case where a sheet bundle SB is pressed as above, pressing forces are exerted on the sheet face from the elastic members 110a2, 110b2, and 110c2.

The first to third pressing members 110a, 110b, and 110c include pressing portions 110a3, 110b3, and 110c3 that directly press a sheet face, support portions 110a4, 110b4, and 110c4 that support the pressing portions 110a3, 110b3, and 110c3, and support shafts 110a5, 110b5, and 110c5 that are integrally connected to the support portions 110a4, 110b4, and 110c4, respectively. The elastic members 110a2, 110b2, and 110c2 are mounted on the support shafts 110a5, 110b5, and 110c5, respectively, and elastically urge the support portions 110a4, 110b4, and 110c4 toward the sheet face side.

The pressing portion 110c3 of the third pressing member 110c is bifurcated when viewed from the direction indicated by the arrow A, and a bifurcated space portion 110c41 is configured so as to allow the discharging claw 52a to pass therethrough, and thus the pressing portion 110c3 of the third pressing member 110c and the discharging claw 52a do not interfere with each other. Accordingly, at a time when the pressing state of the first to third pressing members 110a, 110b, and 110c to the sheet face is released, a sheet bundle SB can be lifted by the discharging claw 52a by driving the discharging belt 52, so that the standby time for the next operation can be minimized. The center of the bifurcated space portion 110c41 in the sheet width direction coincides with an alignment center 53c (see FIG. 17) due to the jogger fence 53.

In addition, in the center portion of the support member 110d, a guide groove 110d1 is formed to be parallel to the second guide shaft 110g. This guide groove 110d1 is used for sliding the sliding member 110k in a direction perpendicular to the sheet conveying direction, and, by loosely fitting a base portion 110k1 of the sliding member 110k therein, the sliding member 110k can be moved in the longitudinal direction of the guide groove 110d1.

Figure 15:
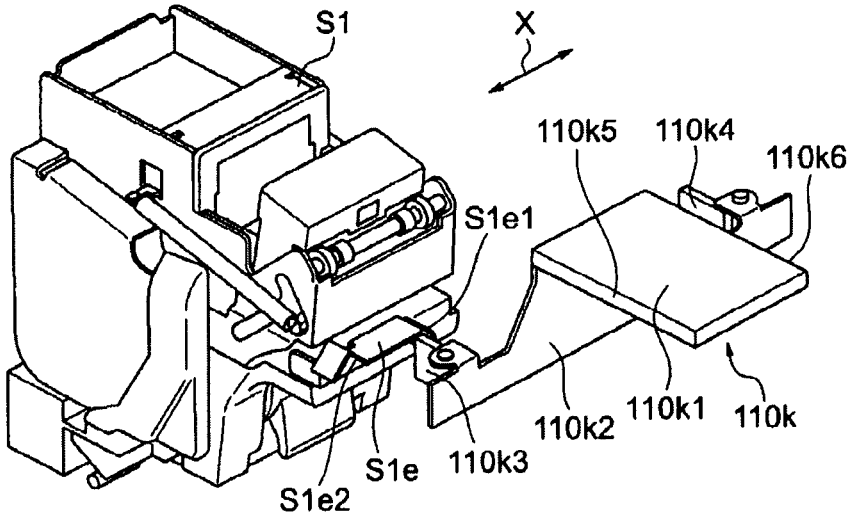
FIG. 15 is a perspective view illustrating the relation between the end-face-binding stapler and a sliding member.

The sliding member 110k, as seen in the perspective view illustrated in FIG. 15, is configured by the base portion 110k1 and a hanging portion 110k2, and the hanging portion 110k2 is formed to be bent downward from the end-face-binding stapler S1 side of the base portion 110k1. The hanging portion 110k2 has a shape extending in the stapler moving direction (sliding direction: indicated by arrow X), and, on the front and rear sides in the moving direction, first and second contacted portions 110k3 and 110k4 with which a contacting member S1*e* provided in the leading edge portion of the end-face-binding stapler S1 on the support member 110d side is brought into contact are provided. An interval between the contacted portions 110k3 and 110k4 is appropriately set in accordance with the moving range of the stapler S1. In addition, in end portions of the base portion 110k1 on the front and rear sides in the moving direction, contacting faces 110k5 and 110k6 are provided. The contacting faces 110k5 and 110k6 are brought into contact with side faces of the support portions 110a4 and 110b4 of the first and second pressing members 110a and 110b, and, the first and second pressing members 110a and 110b are moved in a direction separating away from the third pressing member 110c in resistance to the elastic biasing forces of the elastic members 110m1 and 110m2 by the sliding member 110k that moves in accordance with the movement of the end-face-binding stapler S1. FIG. 15 illustrates a state in which the contacted portion 110k3 is brought into contact with the inner side of the first contacting portion S1*e*1 hanging on the lower side of the contacting member S1*e*.

Figure 16:
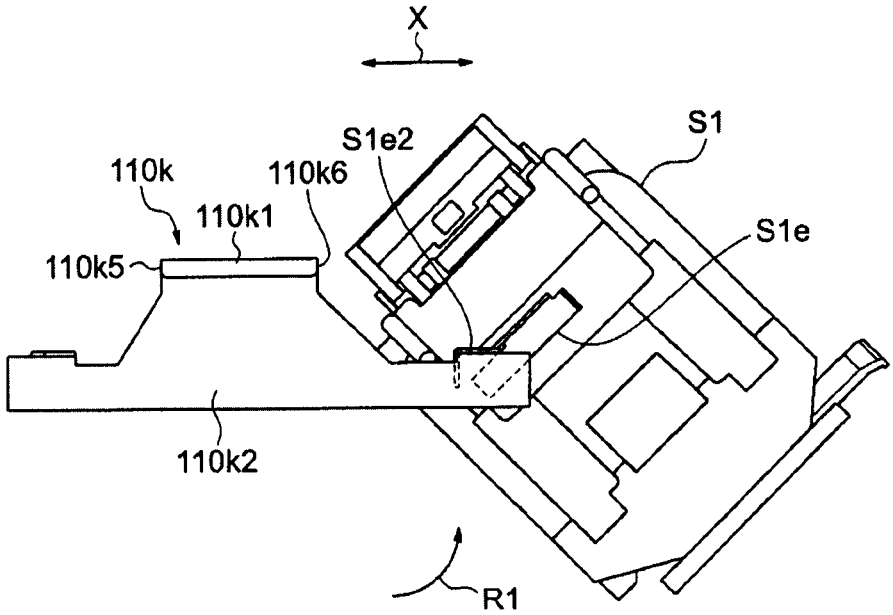
FIG. 16 is a diagram illustrating the relation between the sliding member and the end-face-binding stapler at the time of performing tilted binding.

FIG. 16 is a diagram illustrating the relation between the sliding member 110k and the end-face-binding stapler S1 at the time of performing tilted binding and is a diagram viewed in a direction perpendicular to the stapler moving direction (the direction indicated by the arrow X). FIG. 16 illustrates a tilted binding state in which the second contacting portion S1*e*2, which is in a upward convex shape in an end portion that is on an opposite side to the first contacting portion S1*e*1 of the contacting member S1*e* included in the end-face-binding stapler S1, is in contact with the second contacted portion 110*k*4 of the sliding member 110*k*, and the end-face-binding stapler S1 is rotated (in the direction indicated by arrow R1) by 45 degrees. The operations of the end-face-binding stapler S1 and the sliding member 110*k* will be described later.

A widthwise moving mechanism 50 of the trailing-end reference fence 51 is formed by a base 50*b*, a sliding shaft 50*c*, a timing belt 50*e*, and a widthwise fence driving motor 50*d*3. On both sides of the base 50*b*, side plates 50*a* are vertically mounted, and the sliding shaft 50*c* is supported to be fixed between the side plates 50*a* and supports support portions 51*a*2 and 51*b*2 of the trailing-end reference fences 51*a* and 51*b* in a slidable manner. The timing belt 50*e* is stretched between timing pulleys 50*d*1 and 50*d*2 provided on the driving side and the driven side in parallel with the sliding shaft 50*c*, and is driven to rotate by driving the timing pulley 50*d*1 provided on the driving side by using the widthwise fence driving motor 50*d*3 through the timing belt 50*d*4.

In this widthwise moving mechanism 50, the support portion 51*a*2 of the trailing-end reference fence 51*a* and the support portion 51*b*2 of the trailing-end reference fence 51*b* are mounted on one side 50*e*1 of the timing belt 50*e* parallel to the support portion 51*a*2 and the other side 50*e*2 of the timing belt 50*e* so as to be symmetric with respect to a support member 50*d*5 provided at the center in the width direction. Accordingly, for example, in a case where the timing belt 50*e* rotates right, the support members symmetrically approach the support member 50*d*5 at the center in the width direction and, in a case where the timing belt 50*e* rotates left, the support members are symmetrically separated away from the support member 50*d*5 at the center in the width direction (the direction indicated by the arrow 50*d*7). As a result, the positions of the stack faces 51*a*1 and 51*b*1 and a distance therebetween can be set based on the rotation amount of a fence driving motor 503*d*3. Therefore, in consideration of the easiness in control and the accuracy, as the widthwise fence driving motor 50*d*3, for example, a stepping motor is used.

In addition, as illustrated in FIG. 14, the base 50*b* is connected to a conveying-direction moving mechanism 55 of the trailing-end reference fence 51, and can be vertically moved within a predetermined range in the sheet conveying direction by a driving force transferring mechanism 55*b* that is driven by a conveying-direction fence driving motor 55*a*.

Figure 18:
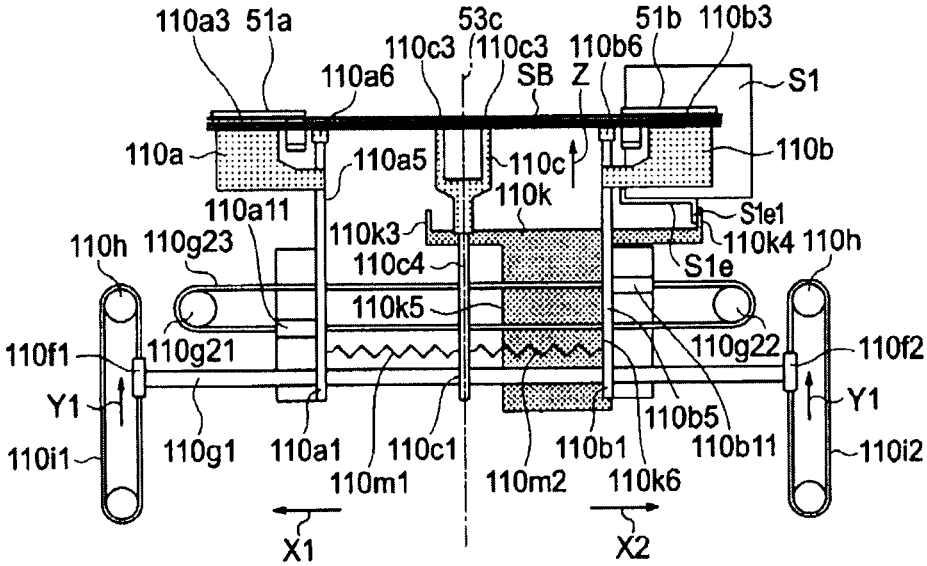
FIG. 18 is an operation explanatory diagram illustrating the relation between the end-face-binding stapler, the first to third pressing members, and the trailing end reference fences at the time of performing rear binding.

FIGS. 17, 18, and 19 are operation diagrams illustrating the relations among the end-face-binding stapler S1, the first to third pressing members 110*a*, 110*b*, and 110*c*, and the trailing-end reference fences 51*a* and 51*b* at the time of front binding, rear binding, and two-point binding, respectively. In addition, FIGS. 20, 21, 22, and 23 are perspective views illustrating the relation among the end-face-binding stapler S1, the first to third pressing members 110*a*, 110*b*, and 110*c*, and the trailing-end reference fences 51*a* and 51*b* at the time of front binding, rear binding, tilted binding, and two-point binding, respectively. FIGS. 24A to 24D are schematic diagrams illustrating the pressing positions of the pressing member. Here, the front binding, the rear binding, and the tilted binding are so-called end binding of end face one-point binding.

In the case of the front binding, as illustrated in FIG. 17, the end-face-binding stapler S1 is moved by the stapler moving motor 159 to a binding position (front binding position) on the front side of the apparatus. Then, as illustrated in FIG. 13, the face of the first contacting portion S1*e*1 of the contacting member S1*e* on the front-side face of the apparatus is brought into contact with the first contacted portion 110*k*3 of the sliding member 110*k*, and the sliding member 110*k* is moved to the apparatus front side (the direction indicated by the arrow X1) in accordance with the movement of the end-face-binding stapler S1. By this movement, the contacting face 110*k*5 of the sliding member 110*k* is brought into contact with the side face of the support portion 110*a*4 of the first pressing member 110*a*, and the first pressing member 110*a* is moved, together with the sliding member 110*k* and in resistance to the elastic biasing force of the elastic member 110*m*1, to a position corresponding to the binding position of the end-face-binding stapler S1. In addition, the second pressing member 110*b* is moved in a direction to be separated from the first pressing member 110*a* (the direction indicated by the arrow X2) in accordance with the rotation of the timing belt 110*g*23, and is located at a position that is symmetric to the first pressing member 110*a* with respect to the third pressing member 110*c*.

In this state, the driving motor 110*j* is driven, and accordingly, the first and second sliders 110*f*1 and 110*f*2 are moved by a predetermined distance in a direction (the direction indicated by the arrow Y1: similarly hereinbelow) pressing a sheet bundle SB. As a result, the pressing portions 110*a*3, 110*b*3, and 110*c*3 of the pressing members 110*a*, 110*b*, and 110*c* are brought into contact with the sheet face of the sheet bundle SB, and are stopped in a pressed state with predetermined pressure (in the direction indicated by the arrow Z: similarly hereinbelow). The pressing forces are given by the elastic forces of the elastic members (tensile coil springs) 110*a*2, 110*b*2, and 110*c*2.

Figure 20:
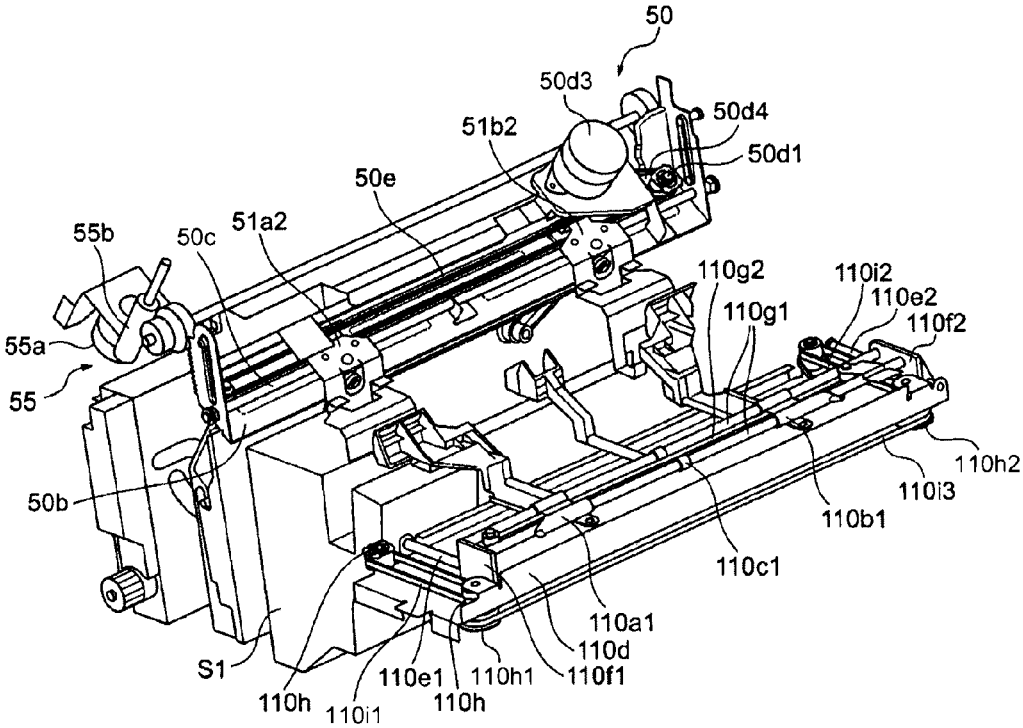
FIG. 20 is a perspective view illustrating the relation between the end-face-binding stapler, the first to third pressing members, and the trailing end reference fences at the time of performing the front binding.
Figure 24A:
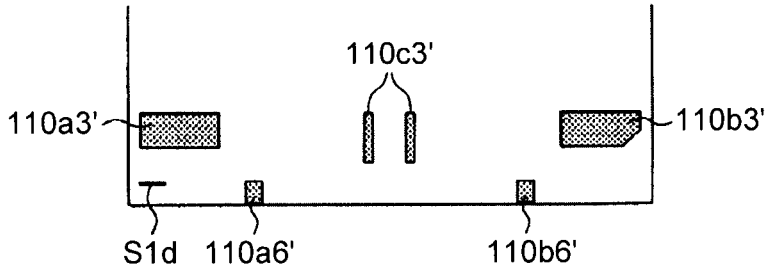
FIGS. 24A to 24D are explanatory diagrams illustrating the pressing positions of the pressing member.

FIG. 20 is a perspective view illustrating a front binding state corresponding to FIG. 17. The relation between the binding position and the pressing positions in this state is illustrated in FIG. 24A. In FIG. 24A, a pressing position of the pressing portion 110*a*3 is denoted by reference numeral 110*a*3', a pressing position of the pressing portion 110*b*3 is denoted by reference numeral 110*b*3', a pressing position of the pressing portion 110*c*3 is denoted by reference numeral 110*c*3', a pressing position of a pressing portion 110*a*6 is denoted by reference numeral 110*a*6', and a pressing position of a pressing portion 110*b*6 is denoted by reference numeral 110*b*6'. In addition, the binding position of the staple S1*d*, as illustrated in the figure, is near the sheet trailing end ST and near the side portion of the front side in the width direction, and it is understood that a sheet bundle SB is held by pressing points near the binding position by using the pressing portions 110*a*3 and 110*a*6 in the front binding illustrated in FIG. 24A.

Figure 21:
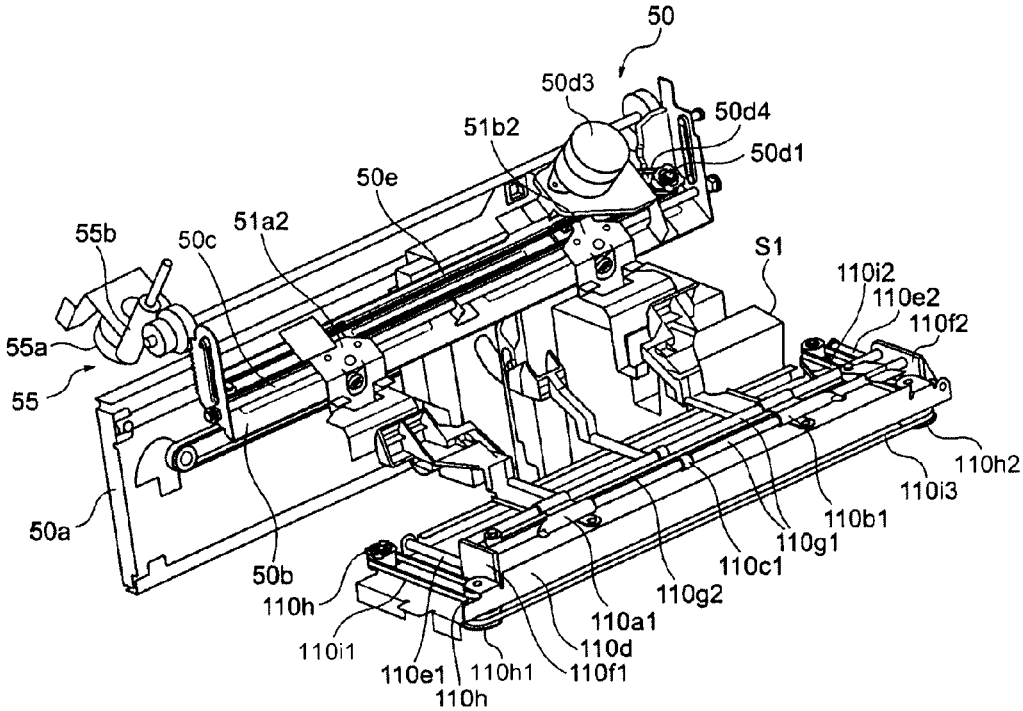
FIG. 21 is a perspective view illustrating the relation between the end-face-binding stapler, the first to third pressing members, and the trailing end reference fences at the time of performing the rear binding.
Figure 22:
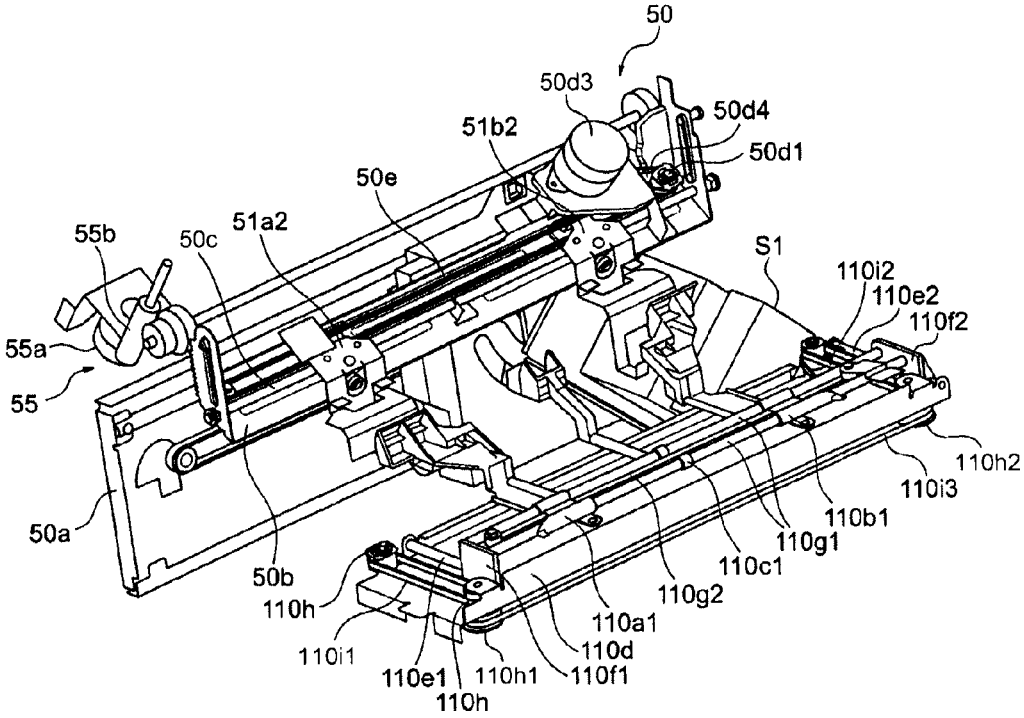
FIG. 22 is a perspective view illustrating the relation between the end-face-binding stapler, the first to third pressing members, and the trailing end reference fences at the time of performing the tilted binding.

FIG. 18 is an example of the case of the rear binding, and the end-face-binding stapler S1 is moved to a binding position (rear binding position) on the rear side of the apparatus. Then, the face of the first contacting portion S1*e*1 of the contacting member S1*e* on the rear side of the apparatus is brought into contact with the second contacted portion 110*k*4 of the sliding member 110*k*, and accordingly, the sliding member 110*k* is moved to the rear side of the apparatus (the direction indicated by the arrow X2) in accordance with the movement of the end-face-binding stapler S1. Although the moving direction of the rear binding is opposite to that of the case of the front binding illustrated in FIG. 16, the operation of the rear binding is similar to that of the case of the front binding. FIG. 21 is a perspective view illustrating a rear binding state corresponding to FIG. 18. The relation between the binding position and the pressing positions in this state is illustrated in FIG. 24B. It is understood that a sheet bundle SB is held by pressing points near the binding position by using the pressing portions 110*b*3 and 110*b*6 in the rear binding illustrated in FIG. 23B.

Figure 24B:
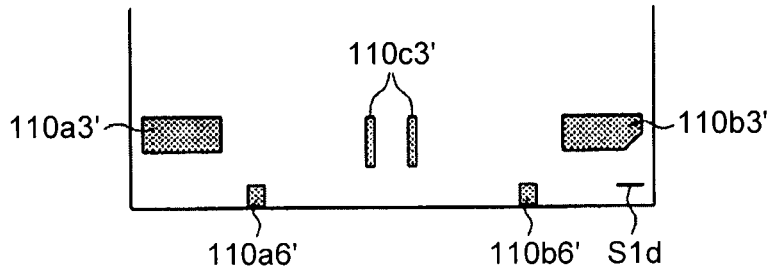
Figure 24C:
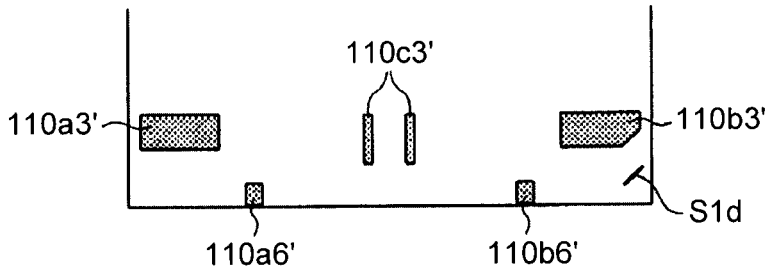

FIG. 24C is a diagram illustrating the relation between the pressing positions and the binding position of the staple S1*d* in the case of tilted binding. In the tilted binding, the stapler S1 is moved from the rear binding position further to the rear side. Then, by regulating the movement of the stapler S1 toward the rear side of the apparatus (the direction indicated by the arrow X2) by using the sliding member 110*k*, as illustrated in FIG. 15, the second contacting portion S1*e*2 of the end-face-binding stapler S1 tends to move further to the rear side while keeping in contact with the second contacted portion 110*k*4 of the sliding member 110*k*, and accordingly, an angular moment is imparted to the end-face-binding stapler S1, and the end-face-binding stapler S1 is rotated in the counterclockwise direction (the direction indicated by the arrow R1) in FIG. 15 around the second contacting portion S1*e*2 while keeping in contact with the second contacted portion 110*k*4 of the sliding member 110*k*. This state is illustrated in the perspective view illustrated in FIG. 22.

Here, because the end-face-binding stapler S1 is set to rotate by 45 degrees, the staple S1*d* is tilted by 45 degrees with respect to the sheet end face, and a binding process is performed in this state. FIG. 24C illustrates the state of this state. In addition, because the end-face-binding stapler S1 is tilted by 45 degrees, when the end-face-binding stapler S1 is rotated to the binding position, the pressing portion 110*b*3 of the second pressing member 110*b* and the end-face-binding stapler S1 interfere with each other. Thus, in this embodiment, by arranging the notch portion 110*b*7 in the pressing portion 110*b*3 of the second pressing member 110*b*, the interference therebetween is prevented.

In addition, in order to define the track of the end-face-binding stapler S1 during the above described rotation operation, as illustrated in FIG. 5, in a slide base 160 of the end-face-binding stapler S1, guide grooves 160*a* and 160*b* for rotation are provided, and protrusions (not illustrated) of the end-face-binding stapler S1 formed on the main body side are loosely fitted therein. Accordingly, the protrusions are moved along the guide grooves 160*a* and 160*b*, so that the end-face-binding stapler S1 is supported, and the operation precision is secured.

Figure 19A:
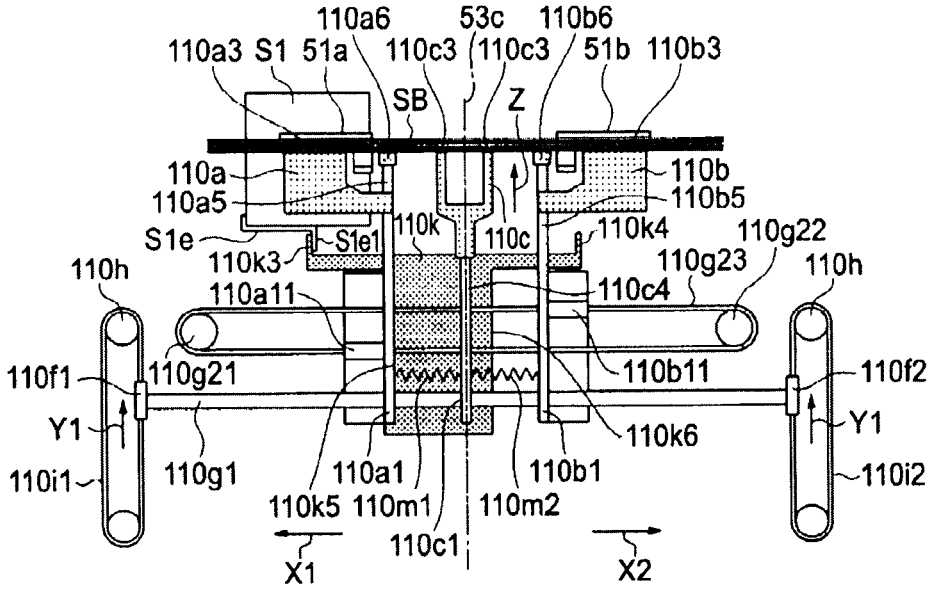
FIGS. 19A and 19B are operation explanatory diagrams illustrating the relation between the end-face-binding stapler, the first to third pressing members, and the trailing end reference fences at the time of performing two-point binding.
Figure 19B:
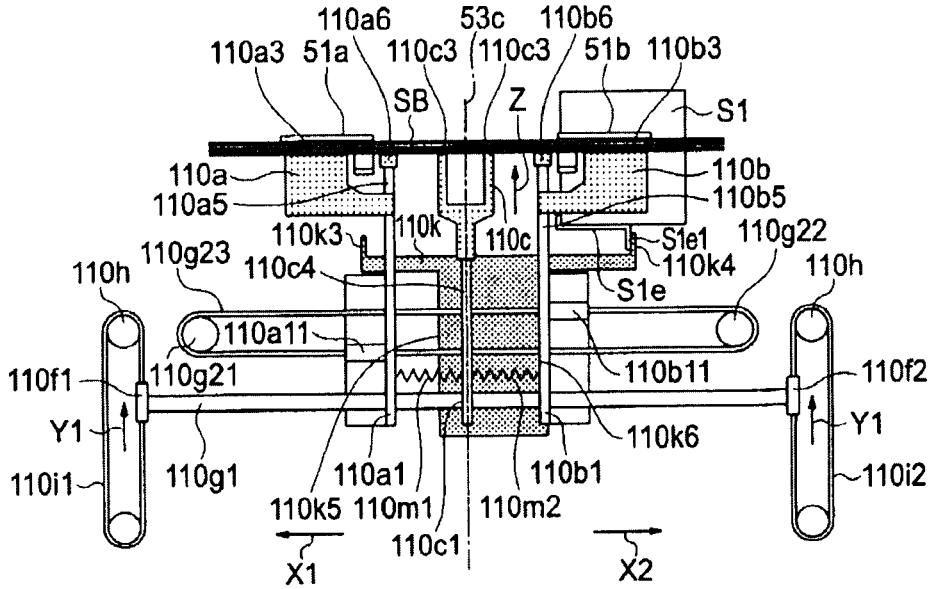

In the case of the two-point binding, as illustrated in FIGS. 19A and 19B, the operation is the same as that of the front binding or the rear binding with the difference only in the binding positions. The binding positions are set as positions near the center of the sheet bundle SB in the width direction to be symmetric with respect to the alignment center 53*c* (the center of the sheet bundle SB in the width direction after alignment). That is, in the front binding illustrated in FIG. 19A, the operation is the same as that of the front binding illustrated in FIG. 17 except for the difference only in the distance from the alignment center 53*c* and, after this operation, the end-face-binding stapler S1 is moved to the rear side, and the rear binding illustrated in FIG. 19B is performed. This rear binding is the same as the rear binding described with reference to FIG. 18 except for the difference only in the distance from the alignment center 53*c*. In the case of the front binding, the rear binding, and the two-point binding, the binding positions are set by controlling the motor driver of the stapler moving motor 159 by using a CPU_PD1 of a control circuit to be described later.

Figure 23A:
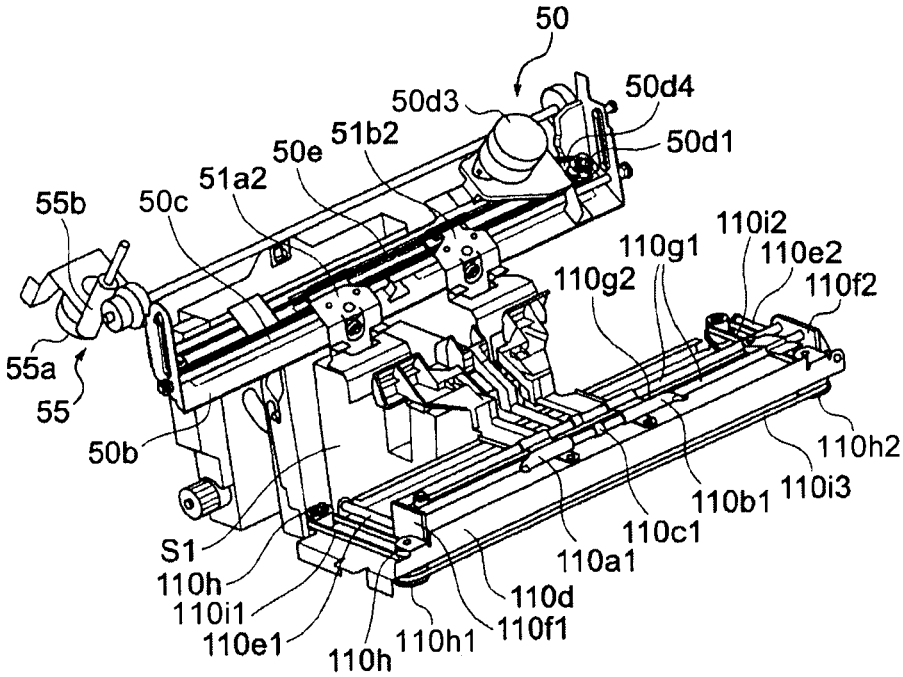
FIG. 23 is perspective views illustrating the relation between the end-face-binding stapler, the first to third pressing members, and the trailing end reference fences at the time of performing the two-point binding.
Figure 23B:
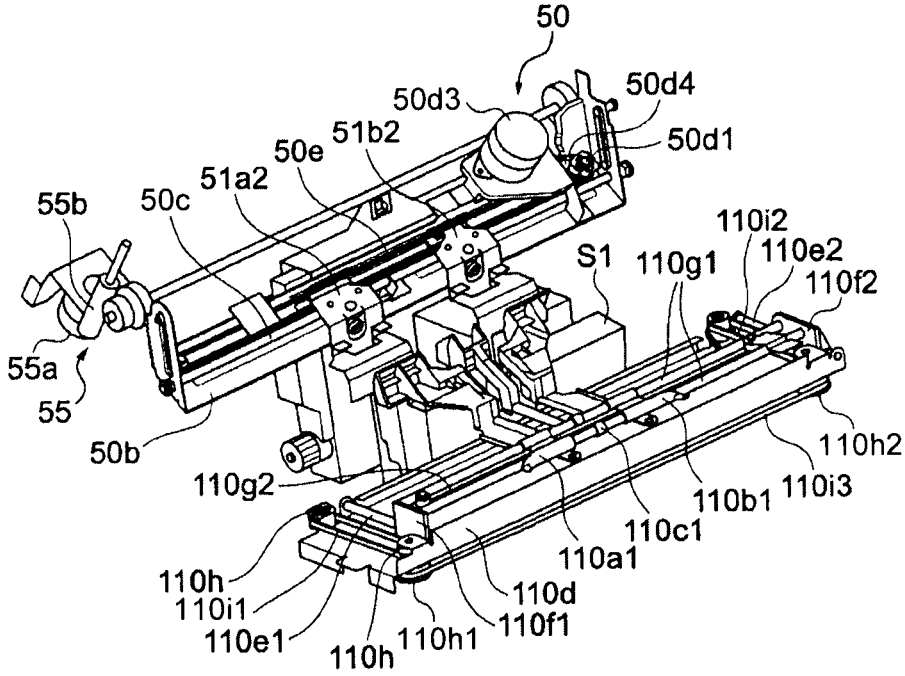
Figure 24D:
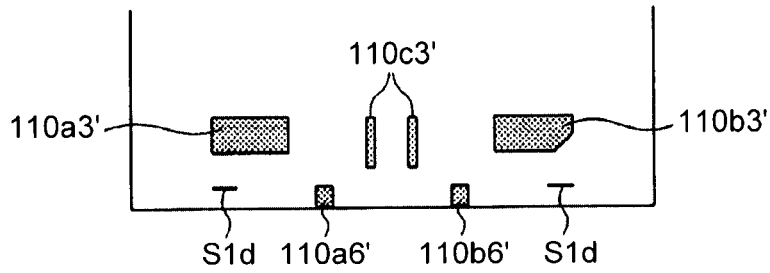

FIG. 23A is a perspective view of the case of the front binding in the two-point binding, FIG. 23B is a perspective view of the case of the rear binding therein, and, in both cases, the first and second pressing members 110*a* and 110*b* are moved to positions near the binding position in accordance with the movement of the end-face-binding stapler S1. The relation between the binding position and the pressing positions at this time is illustrated in FIG. 24D. From the two-point binding illustrated in FIG. 24D, it can be understood that the sheet bundle SB is held by being pressed at the pressing positions near the binding position by using the pressing portions 110*a*3 and 110*a*6 or 110*b*3 and 110*b*6.

Figure 25:
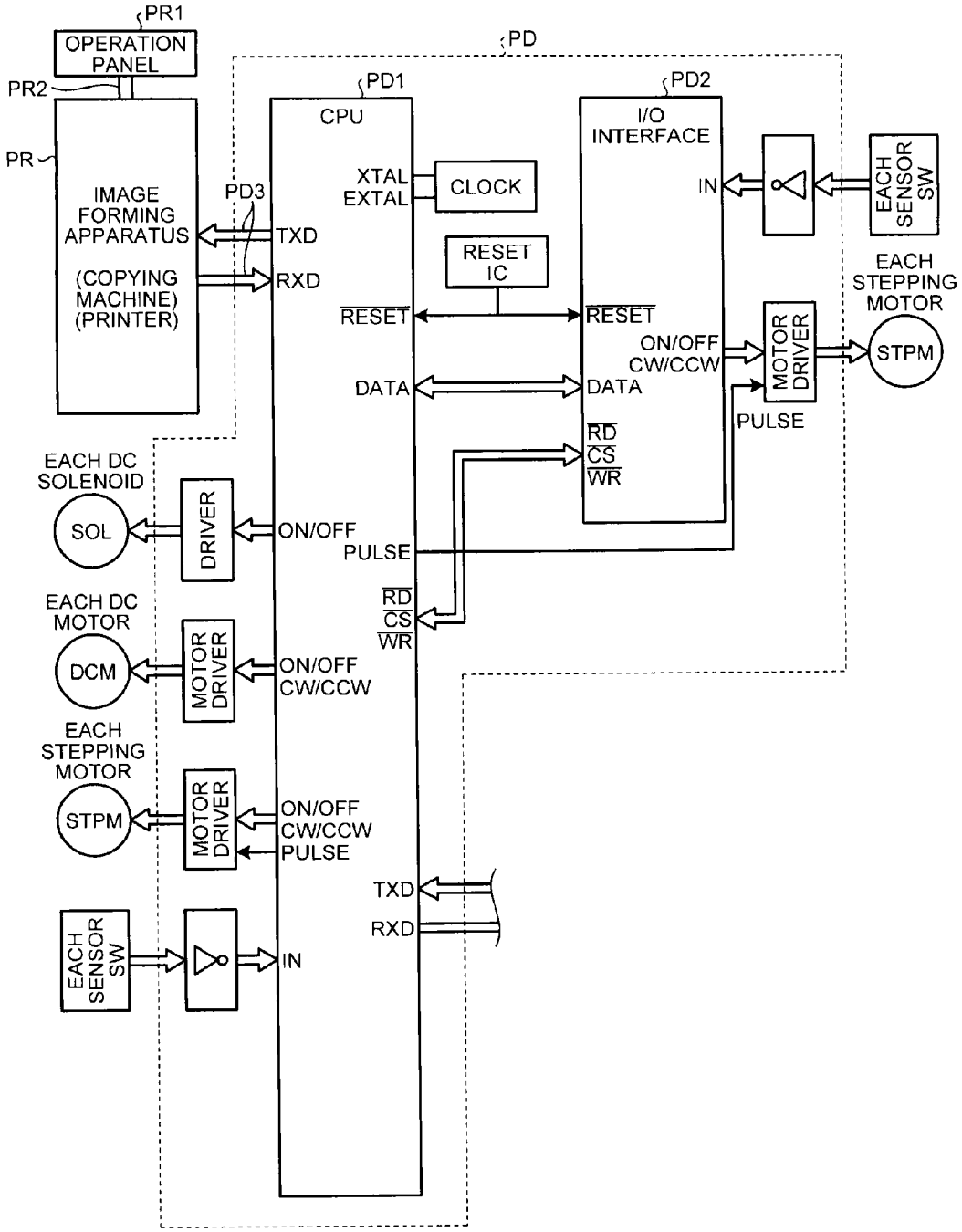
FIG. 25 is a block diagram illustrating the control configuration of an image forming system formed by a sheet post-processing apparatus and an image forming apparatus.

FIG. 25 is a block diagram illustrating the control configuration of an image forming system that is formed by the sheet post-processing apparatus PD and the image forming apparatus PR. The sheet post-processing apparatus PD includes the control circuit on which a microcomputer including the CPU_PD1, an I/O interface PD2, and the like is mounted. A signal transmitted from the CPU, each switch of an operation panel PR1, or the like of the image forming apparatus PR, or a signal from each sensor (not illustrated) is input into the CPU_PD1 through a communication interface PD3, and the CPU_PD1 performs predetermined control based on the input signal. In addition, the CPU_PD1 performs driving control of the solenoid and the motor through a driver and a motor driver, respectively, thereby acquiring information on a sensor inside the apparatus from an interface thereof. Furthermore, the CPU_PD1 performs driving control of the motor by using the motor driver in accordance with a control target or a sensor through the I/O interface PD2, thereby acquiring sensor information from each sensor. In addition, the above-described control operation is performed by the CPU_PD1 that reads a program code stored in a ROM (not illustrated), load a computer program written in the program code in a random access memory (RAM) (not illustrated) that is used as a work area and a data buffer.

In addition, the control of the sheet post-processing apparatus PD illustrated in FIG. 25 is performed based on an instruction or information transmitted from the CPU of the image forming apparatus PR. An operational instruction by a user is designated by using the operation panel PR1 of the image forming apparatus PR, and the image forming apparatus PR and the operation panel PR1 are interconnected through a communication interface PR2. Accordingly, an operational signal is transmitted from the operation panel PR1 of the image forming apparatus PR to the sheet post-processing apparatus PD, and the user or an operator is notified of a process state or a function of the sheet post-processing apparatus PD through the operation panel PR1.

Second Embodiment

Figure 26:
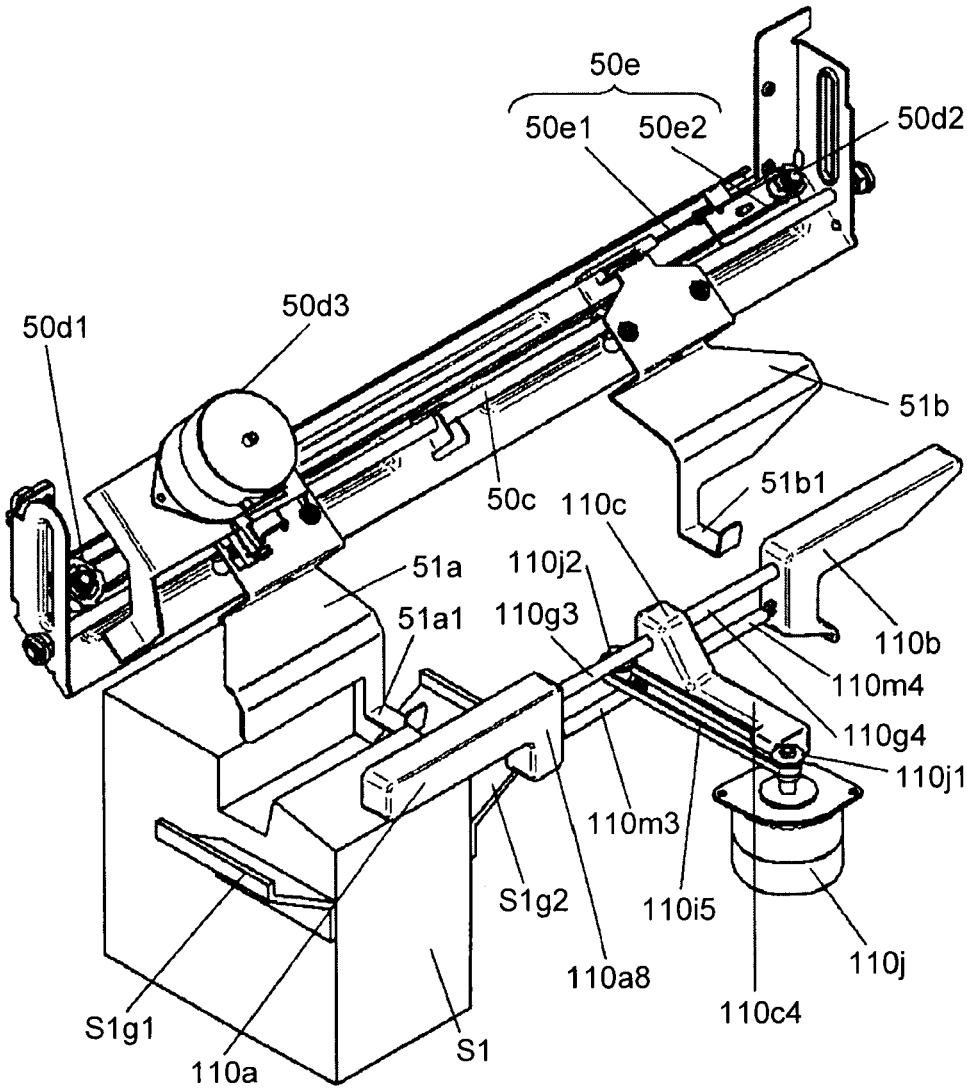
FIG. 26 is a detailed perspective view illustrating the relation between an end-face-binding processing tray, trailing end reference fences, and a pressing member according to a second embodiment, and illustrates a state in which the sheet bundle is not pressed.
Figure 27:
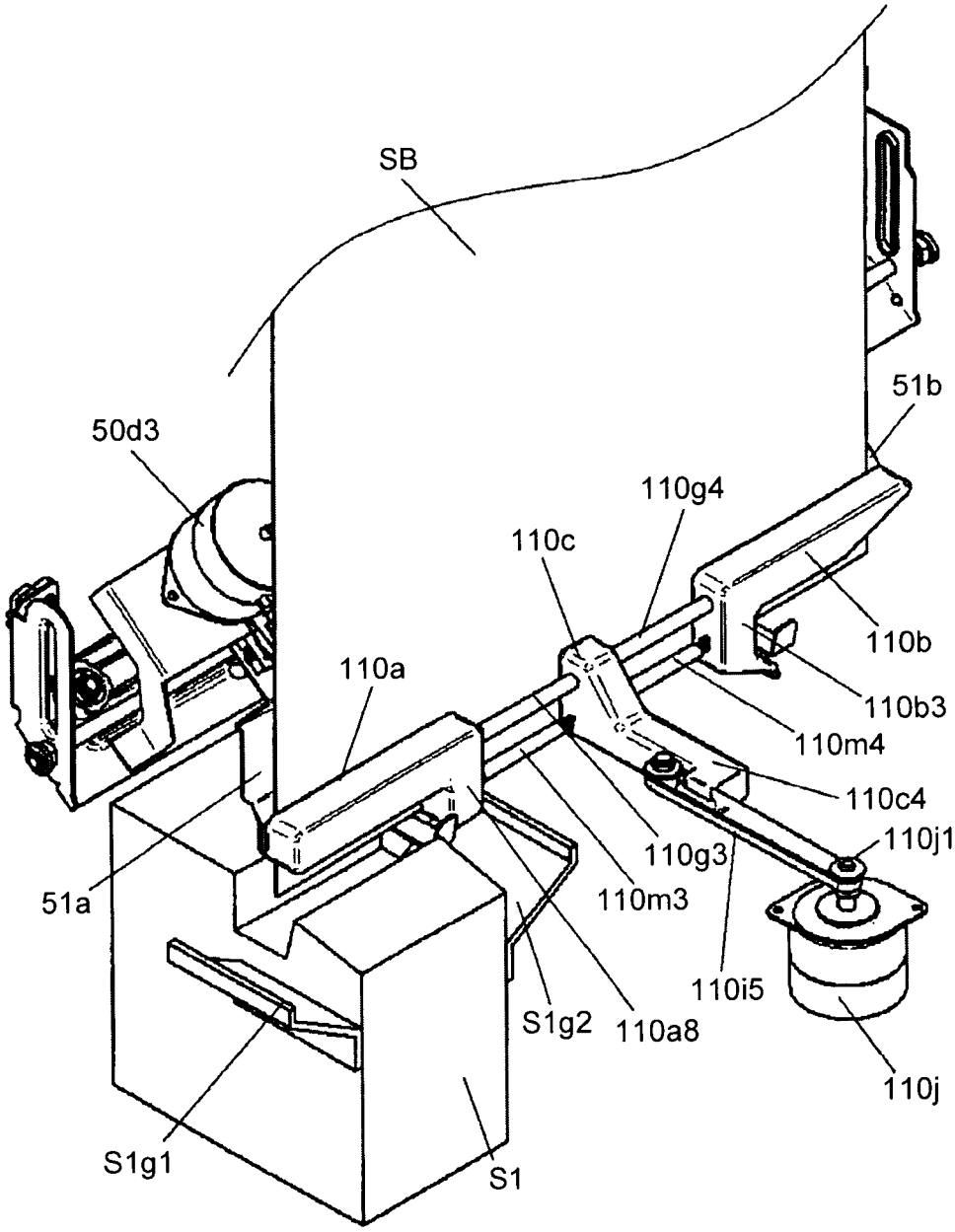
FIG. 27 is a detailed perspective view illustrating the relation between the end-face-binding processing tray, the trailing end reference fences, and the pressing member, and illustrates a state in which the sheet bundle is pressed.
Figure 28:
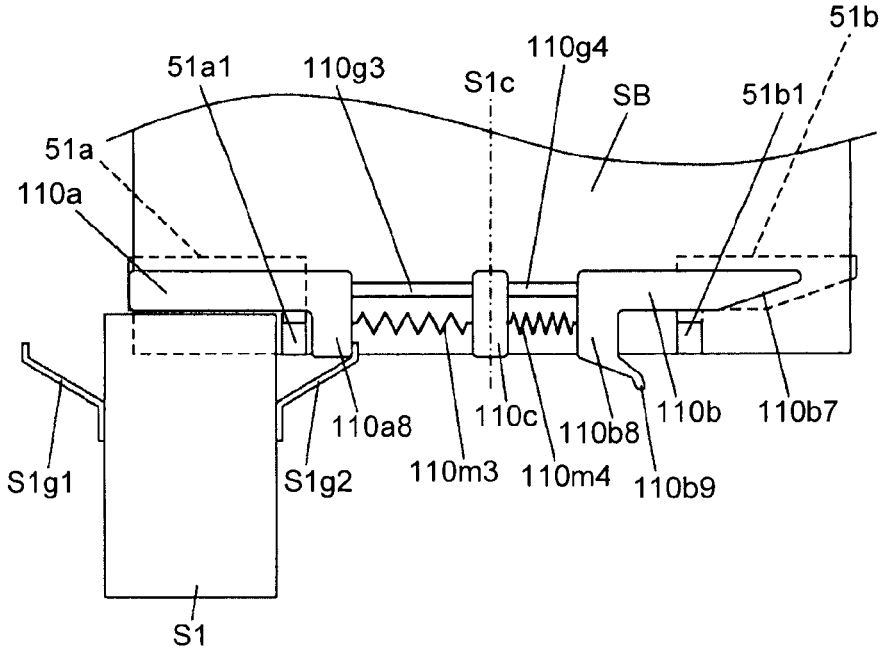
FIG. 28 is a side view illustrating a state of pressing the sheet bundle at the time of performing front binding.
Figure 29:
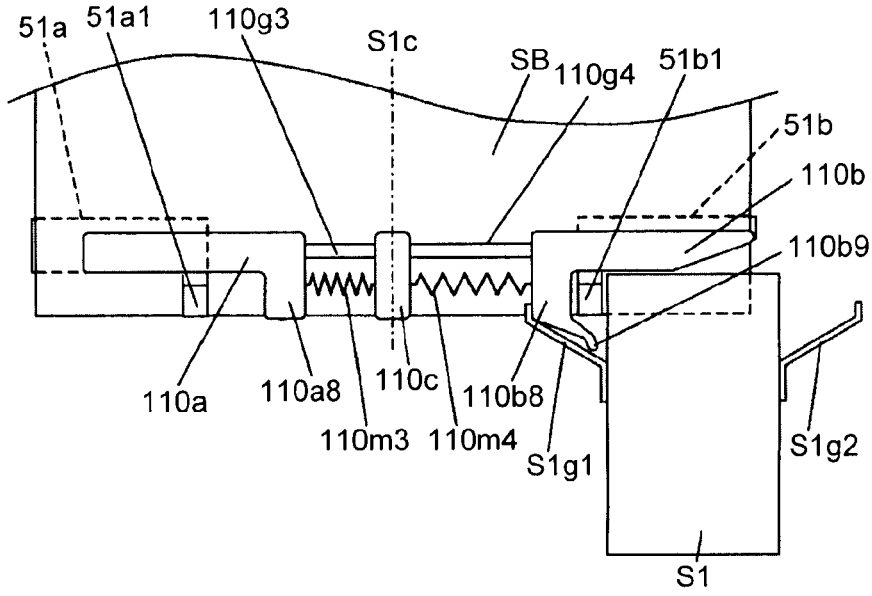
FIG. 29 is a side view illustrating a state of pressing the sheet bundle at the time of performing rear binding.
Figure 30:
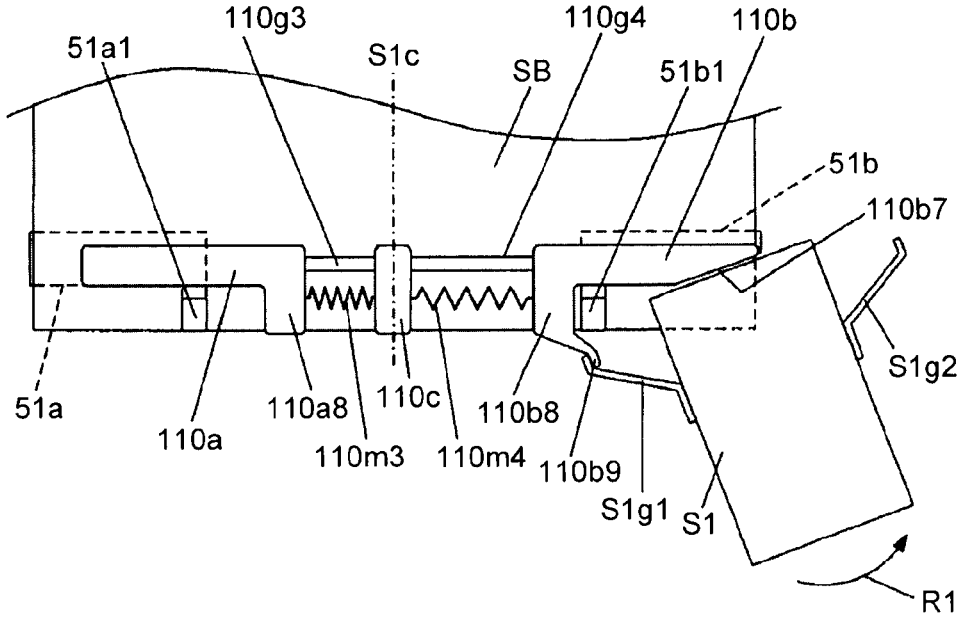
FIG. 30 is a side view illustrating a state of pressing the sheet bundle at the time of performing tilted binding.
Figure 31:
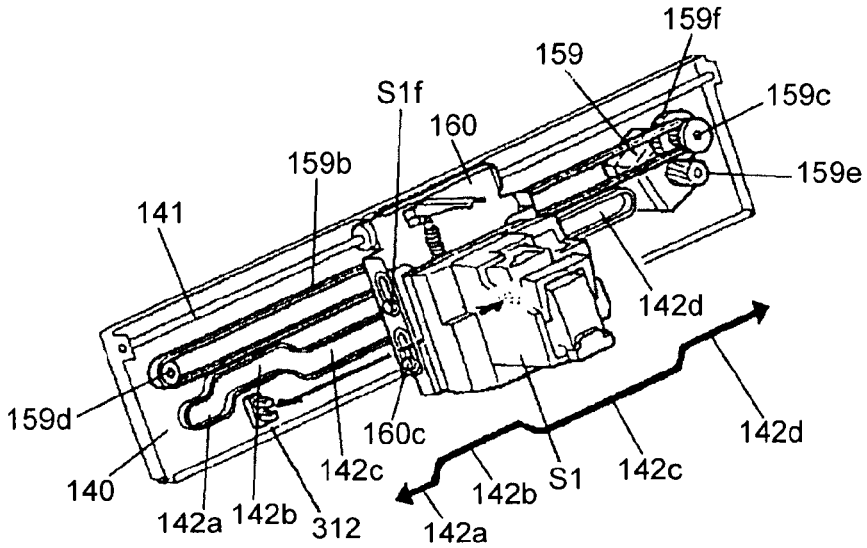
FIG. 31 is a perspective view illustrating a conveying mechanism of an end-face-binding stapler according to the second embodiment.

FIGS. 26 to 31 are explanatory diagrams for describing a second embodiment. FIG. 26 is a detailed perspective view illustrating the relation among an end-face-binding processing tray F, trailing-end reference fences 51*a* and 51*b*, and a pressing member 110, and illustrates a state in which a sheet bundle is not pressed. FIG. 27 is a perspective view illustrating a state in which the sheet bundle is pressed, FIG. 28 is a side view illustrating a state in which the sheet bundle is pressed during front binding, FIG. 29 is a side view illustrating a state in which the sheet bundle is pressed during rear binding, FIG. 30 is a side view illustrating a state in which the sheet bundle is pressed during tilted binding, and FIG. 31 is a perspective view illustrating a conveying mechanism of an end-face-binding stapler S1 according to the present embodiment.

Here, the configuration and the operation of each unit according to the first embodiment illustrated in FIGS. 1 to 7 are the same as or equivalent to those of the present embodiment except for a conveying mechanism of the end-face-binding stapler S1 illustrated in FIG. 5, and thus duplicate description will not be repeated.

FIG. 26 illustrates the relation among the end-face-binding processing tray F, the trailing-end reference fences 51*a* and 51*b*, and the pressing member 110. Among these, an end-face-binding stapler S1 reciprocates in the sheet width direction along a support plate 140 illustrated in FIG. 31, and the trailing-end reference fences 51*a* and 51*b*, similarly to the first embodiment, perform an approaching or separating operation in the sheet width direction along the sliding shaft 50*c*. First and second pressing members 110*a* and 110*b* are moved in the sheet width direction in association with the moving operation of the end-face-binding stapler S1, but a third pressing member 110*c* is not moved in the sheet width direction. In addition, the first to third pressing members 110*a*, 110*b*, and 110*c* reciprocate in a direction perpendicular to the sheet face in accordance with the rotation of a driving motor 110*j* and a timing belt 110*i*5 that is driven to rotate by the driving motor 110*j*. The timing belt 110*i*5 is stretched between a driving pulley 110*j*1 that is fitted to a driving shaft of the driving motor 110*j* and a driven pulley 110*j*2 provided at a position closer to the sheet face than the driving pulley 110*j*1, and a support portion 110*c*4 of the third pressing member 110*c* is connected to the timing belt 110*i*5. In addition, guide shafts 110*g*3 and 110*g*4 are fixed to the support portion 110*c*4, and the first to third pressing members 110*a*, 110*b*, and 110*c* integrally reciprocate in a direction perpendicular to the sheet face. Furthermore, elastic members (for example, tensile coil springs) 110*m*3 and 110*m*4 elastically bias the first and second pressing members 110*a* and 110*b* in a direction to approach each other with respect to the third pressing member 110*c*.

The end-face-binding stapler S1 is supported, as illustrated in FIG. 31, by a sliding shaft 141 that is supported on both ends by side plates of the support plate 140 and a sliding groove 142 formed in the support plate 140 so as to be approximately parallel to the sliding shaft 141. In the sliding groove 142, a parallel portion is divided into four parts including first to fourth sliding groove portions 142*a*, 142*b*, 142*c*, and 142*d*, thereby configuring one moving path.

The first sliding groove portion 142*a* is provided at a staple replacing position of the end-face-binding stapler S1. The second sliding groove portion 142*b* is provided at a position for the front binding and the front side of the two-point binding. The third sliding groove portion 142*c* is provided at a center portion of the sliding groove 142 by retreating from the end portion of the sheet bundle so as to prevent interference between the end-face-binding stapler S1 and the third pressing member 110*c*; this is also a position which the end-face-binding stapler S1 passes through in moving to the position for the rear binding and on the rear side of the two-point binding. And the fourth sliding groove portion 142*d* is provided at a position for the rear binding and on the rear side in the two-point binding. The distances of the parallel portions of the first and third sliding groove portions 142*a* and 142*c* from the sliding shaft 141 are equal to each other, and similarly, the distances of the parallel portions of the second and fourth sliding groove portions 142*b* and 142*d* from the sliding shaft 141 are equal to each other.

On the other hand, a timing belt 159*b* is stretched between pulleys 159*c* and 159*d* so as to be parallel to the sliding shaft 141, and the timing belt 159*b* is driven by driving a stapler moving motor 159 that is forwardly or reversely rotatable through gears 159*e* and 159*f*. Because the end-face-binding stapler S1 is attached to the timing belt 159*b*, the rotational driving force of the stapler moving motor 159 is transferred to the end-face-binding stapler S1, and the end-face-binding stapler S1 is moved in the sheet width direction along the sliding shaft 141 and the sliding groove 142 so as to bind the sheets at a predetermined position in the sheet trailing end portion.

In addition, a support protrusion S1*f* protrudes from a side portion of the main body of the end-face-binding stapler S1, and is loosely fitted into a long hole 160*c* that is formed in a side plate of a slide base 160. The long hole 160*c* is formed to be parallel to a base face of the slide base 160, and accordingly, the end-face-binding stapler S1 can be moved in the longitudinal direction (a direction approaching or separating from the sliding shaft 141) along the base face.

By being configured as described above, while the slide base 160 moves from the front side to the rear side (in the sheet width direction) along the sliding shaft 141, the end-face-binding stapler can be moved to a front binding position, the front side in the two-point binding, the rear side in the two-point binding and, after avoiding (bypassing) the third pressing member 110*c*, a rear binding position, or a tilted binding position.

In addition, on both side faces of the end-face-binding stapler S1 in a moving direction thereof, first and second engaging members S1*g*1 and S1*g*2 are provided in a protruding manner. The first engaging member S1*g*1 is arranged on the front side in the moving direction, and the second engaging member g2 is arranged on the rear side in the moving direction, and when the end-face-binding stapler S1 is moved to the front side as illustrated in FIG. 26, the second engaging member S1*g*2 is brought into contact with the rear-side side face of the first pressing member 110*a*, and moves to the front side integrally with the pressing member 110*a*.

Every time one sheet is discharged, alignment of the trailing end of a sheet bundle is performed by the trailing-end reference fences 51*a* and 51*b*, and alignment of the sheet bundle in the width direction is performed by jogger fences 53*a* and 53*b*. In the case of the end-face-binding, the end-face-binding stapler S1 and the first trailing-end reference fence 51*a* move to the position illustrated in FIGS. 26 and 28, and the second trailing-end reference fence 51*b* is elastically biased toward the alignment center S1*c* by an elastic member 110*m*2 on standby at the initial position located on the rear side. In this positional relation, when the sheet is discharged onto the end-face-binding processing tray F, and the above-described alignment operation is repeated, so that a sheet bundle SB for one job is stacked on stack faces 51*a*1 and 51*b*1 of the trailing-end reference fences 51*a* and 51*b*, as illustrated in FIG. 27, the driving motor 110*j* is driven to move the third pressing member 110*c* toward the sheet bundle SB so as to press the sheet bundle SB against the trailing-end reference fences 51*a* and 51*b* by the first and second pressing members 110*a* and 110*b* that are integrally moved, and a binding process using the end-face-binding stapler S1 is performed in this state. Accordingly, the end binding for the sheet bundle SB is performed.

Then, as illustrated in FIGS. 27 and 28, the moving positions of the first and second pressing members 110*a* and 110*b* are set such that interference between a hanging portion 110*a*8 of the first pressing member 110*a* and the stack face 51*a*1 of the first trailing-end reference fence 51*a* and interference between a hanging portion 110*b*8 of the second pressing member 110*b* and the stack face 51*b*1 of the second trailing-end reference fence 51*b* do not occur.

FIG. 29 illustrates the relation among the end-face-binding stapler S1, the second pressing member 110*b*, and the second trailing-end reference fence 51*b* in the case of the rear binding, and the end-face-binding stapler S1 that has passed through the third pressing member 110*c* as described above moves to the rear-side binding position that is symmetric to the binding position in the case of the front binding illustrated in FIG. 28 with respect to the alignment center S1*c* in the sheet width direction. Then, the first engaging member S1*g*1 of the end-face-binding stapler S1 is engaged with the hanging portion 110*b*8 of the second pressing member 110*b*, and the second pressing member 110*b* is integrally moved in accordance with the movement of the end-face-binding stapler S1.

In this state, as illustrated in FIG. 29, the driving motor 110*j* is driven so as to advance the first to third pressing members 110*a*, 110*b*, and 110*c*, and the sheet bundle SB is pressed to be held between the trailing-end reference fences 51*a* and 51*b*. In this state, the rear binding is performed by the end-face-binding stapler S1.

FIG. 30 illustrates a case where the end-face-binding stapler S1 is moved further to the rear side from the state illustrated in FIG. 29, and a tilted binding state is formed. When the end-face-binding stapler S1 is conveyed further to the rear side from the state illustrated in FIG. 29, as described with reference to FIG. 16 in the first embodiment, the end-face-binding stapler S1 rotates in the direction indicated by the arrow R1 about a rotation center (not illustrated), and the tilted binding state is formed. The rotation range is set, as illustrated in FIG. 30, by engaging the first engaging member S1*g*1 with an engaging portion 110*b*9 formed on the leading end of the hanging portion 110*b*8 of the second pressing member 110*b*.

In the case of the tilted binding as illustrated in FIG. 30, because the end-face-binding stapler S1 rotates, and the upper face of the end-face-binding stapler S1 and the lower portion of the second pressing member 110*b* interfere with each other, similarly to the first embodiment, a notch portion 110*b*7 is provided in the lower portion of the second pressing member 110*b* in accordance with the shape of the end-face-binding stapler S1 at the time of rotation, so that interference therebetween is prevented.

As described above, in the case of the rear binding or the case of the tilted binding, a position near the binding position of the end-face-binding stapler S1 is pressed by the second pressing member 110*b* that follows the end-face-binding stapler S1 or moves in association with the end-face-binding stapler, so that the binding process is performed in a state in which a sheet bundle SB is securely held.

The other units that have not been particularly described are configured to be the same as those of the above-described first embodiment and similarly function.

In addition, in the present embodiment, elastic members 110*m*3 and 110*m*4 elastically bias the first and second pressing members 110*a* and 110*b* constantly toward the third pressing member 110*c* side, only the pressing member provided on the engaging side, that is, the pressing member provided on the binding side moves to the side of the binding position, and the pressing member provided on the non-engaging side holds the sheet bundle SB by being located at the initial position near the third pressing member 110*c*.

In the first and second embodiments, as the moving mechanism of the first and second pressing members 110*a* and 110*b*, a mechanism associated with the movement of the end-face-binding stapler S1 is employed, for example; however, the moving mechanism thereof may be configured such that the first and second pressing members 110*a* and 110*b* are moved by using the moving mechanism of the end-face-binding stapler S1 or the moving mechanism of the trailing end reference fence.

In addition, in the first and second embodiments, although the first to third pressing members 110*a*, 110*b*, and 110*c* integrally perform an approaching or separating operation for the sheet bundle SB, driving units may be provided for each of the pressing members so that the corresponding pressing members can be driven independently of others. Furthermore, the driving mechanism is not limited to the mechanism described in the embodiments, as long as the driving mechanism is configured to be capable of performing a straight reciprocating motion.

In addition, a mechanism that can perform an approaching or separating operation other than the straight reciprocating motion for the sheet face of a sheet bundle SB and can reliably press and hold the sheet bundle SB at the time of performing a binding process may be used without being limited to the mechanism described in the embodiments.

Furthermore, in the first and second embodiments, although three pressing members are provided, neither the number of pressing members nor the number of pressing points is limited thereto. The number of the pressing members or the pressing points can be arbitrary, as long as positions near the binding position can be appropriately pressed.

As described above, according to the present embodiment, because the first and second pressing members 110*a* and 110*b* that press a sheet bundle SB move in the sheet width direction in association with the movement of the end-face-binding stapler S1 by being in near contact with the end-face-binding stapler S1, a position near the stapling position can be constantly pressed by the pressing members regardless of a sheet size, a binding position, a binding method, or the like. Accordingly, the bending of a sheet or a sheet bundle that may deteriorate the accuracy in the alignment at the time of performing a binding operation by using the end-face-binding stapler S1 can be suppressed, so that high binding accuracy can be constantly secured.

In the embodiments described above, the sheet bundle corresponds to reference sign SB, the stacking unit corresponds to the end-face-binding processing tray F, the aligning unit corresponds to the first and second trailing-end reference fences 51*a* and 51*b*, the end portion on the binding unit side corresponds to the sheet trailing end ST, the binding unit corresponds to the end-face-binding stapler S1, the pressing unit corresponds to the first to third pressing members 110*a*, 110*b*, and 110*c*, the interlocking unit corresponds to the sliding member 110*k*, the first and second engaging members S1*e*1 and S1*e*2 correspond to the first and second engaging members S1*g*1 and S1*g*2 of the end-face-binding stapler S1, the sheet conveying direction corresponds to the direction indicated by the arrow J, the first support member corresponds to the second guide shaft 110*g*1, the elastic biasing unit corresponds to the elastic members 110*m*1 and 110*m*2, the driving source corresponds to the stapler moving motor 159, the first driving unit corresponds to the sliding shaft 141, the sliding groove 142, and the timing belts 159*a* and 159*b*, the engaging member corresponds to the sliding member 110*k*, the connecting unit corresponds to the timing belt 110*g*23, the first contacting portion corresponds to the first contacted portion 110*k*3, the first contacting face corresponds to the contacting face 110*k*5, the second contacting portion corresponds to the second contacted portion 110*k*4, the second contacting face corresponds to the reference sign 110*k*6, the moving mechanism corresponds to the guide shafts 110*g*3 and 110*g*4, the elastic biasing unit corresponds to the elastic members 110*m*3 and 110*m*4, the notch portion corresponds to the notch portion 110*b*7, the second support member corresponds to the sliding shaft 50*c*, the second driving unit corresponds to the timing belt 50*e* and the fence driving motor 50*d*3 in the width direction, one driving source corresponds to the driving motor 110*j*, the third driving unit corresponds to the timing belt **110*i*5 and the support portion 110*c*4**, the sheet processing apparatus corresponds to the sheet post-processing apparatus PD, and the image forming apparatus corresponds to the reference sign PR.

According to the embodiments, high precision can be achieved in the alignment of the sheet bundle regardless of the sheet size and the binding position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a stacking unit configured to stack conveyed sheets;

an aligning unit configured to align the sheets stacked on the stacking unit in a sheet conveying direction;

a binding unit configured to move along an end portion of a bundle of the sheets on a binding portion side and perform a binding process for the bundle of the sheets that have been aligned by the aligning unit;

a pressing unit configured to press the bundle of the sheets at the end portion thereof on the binding portion side;

an interlocking unit configured to move the pressing unit in association with a motion of the binding unit; and a moving mechanism configured to move, another one of the pressing members symmetric to the one of the pressing members, when the pressing unit includes a plurality of pressing members and one of the pressing members moves in association with the binding unit, wherein the moving mechanism includes:

first and second pressing members configured to press both end portions of the bundle of the sheets;

a third pressing member configured to press a center portion of the bundle of the sheets;

a first support member configured to support the first and second pressing members in a slidable manner in a direction perpendicular to the sheet conveying direction;

an elastic biasing unit configured to elastically bias each of the first and second pressing members toward the third pressing member; and a driving unit including a driving source configured to cause the binding unit to reciprocate in the direction perpendicular to the sheet conveying direction, wherein the interlocking unit includes:

an engaging member configured to move by being engaged with the binding unit when the binding unit moves and is configured to be brought into contact with one of the first and second pressing members so that the engaging member integrally moves with the one of the first and second pressing members when the binding unit moves; and a connecting unit configured to allow another one of the first and second pressing members to perform an operation that is symmetric to a moving operation of the one of the first and second pressing members along the first support member.

2. The sheet processing apparatus according to claim 1, wherein when the binding unit is configured to be brought into contact with the pressing unit, the interlocking unit moves the pressing unit by keeping a contact therebetween.

3. The sheet processing apparatus according to claim 1, wherein the pressing unit is configured to press a point on an upstream side of a binding position by the binding unit in the sheet conveying direction.

4. The sheet processing apparatus according to claim 1, further comprising:

a first contacting portion with which the engaging member is configured to be brought into contact and a first contacting face that is configured to be brought into contact with the pressing member when the binding unit moves in one direction; and a second contacting portion with which the engaging member is configured to be brought into contact and a second contacting face that is configured to be brought into contact with the pressing member when the binding unit moves in another direction.

5. The sheet processing apparatus according to claim 1, wherein the pressing unit includes:

a plurality of pressing members; and a moving mechanism configured to move one of the pressing members in association with the binding unit and maintain another one of the pressing members at an initial position that is located on a center side of the sheets in a width direction.

6. The sheet processing apparatus according to claim 5, further comprising:

the elastic biasing unit further configured to elastically bias the one of the pressing members and the another one of the pressing members in a direction to approach each other.

7. The sheet processing apparatus according to claim 1, wherein the pressing member that is configured to press a position near the binding position of the binding unit includes a notch portion that is used for avoiding interference with the binding unit when the binding unit performs tilted binding.

8. The sheet processing apparatus according to claim 1, further comprising:

a second support member configured to support the aligning unit in a slidable manner in a direction perpendicular to the sheet conveying direction; and a second driving unit configured to move the aligning unit to a position facing the pressing member along the second support member in accordance with movement of the pressing member in the direction perpendicular to the sheet conveying direction.

9. The sheet processing apparatus according to claim 1, wherein the pressing unit includes a plurality of pressing members, wherein the sheet processing apparatus further includes a third driving unit configured to press the bundle of the sheets by driving the plurality of pressing members to approach or to be separated from the bundle of the sheets in a sheet bundle direction by using one driving source.

10. An image forming system, comprising:

a sheet processing apparatus that includes:

a stacking unit configured to stack conveyed sheets;

an aligning unit configured to align the sheets stacked on the stacking unit in a sheet conveying direction;

a binding unit configured to move along an end portion of a bundle of the sheets on a binding portion side and perform a binding process for the bundle of the sheets that have been aligned by the aligning unit;

a pressing unit configured to press the bundle of sheets at the end portion thereof on the binding portion side; and an interlocking unit configured to move the pressing unit in association with a motion of the binding unit, and an image forming apparatus configured to convey the sheets on which image formation has been performed to the sheet processing apparatus, a moving mechanism configured to move another one of the pressing members to be symmetric to the one of the pressing members, when the pressing unit includes a plurality of pressing members and one of the pressing members moves in association with the binding unit, wherein the moving mechanism includes:

first and second pressing members configured to press both end portions of the bundle of the sheets;

a third pressing member configured to press a center portion of the bundle of the sheets;

a first support member configured to support the first and second pressing members in a slidable manner in a direction perpendicular to the sheet conveying direction;

an elastic biasing unit configured to elastically bias each of the first and second pressing members toward the third pressing member; and a driving unit including a driving source configured to cause the binding unit to reciprocate in the direction perpendicular to the sheet conveying direction, wherein the interlocking unit includes:

an engaging member configured to move by being engaged with the binding unit when the binding unit moves and is configured to be brought into contact with one of the first and second pressing members so that the engaging member integrally moves with the one of the first and second pressing members when the binding unit moves; and a connecting unit configured to allow another one of the first and second pressing members to perform an operation that is symmetric to a moving operation of the one of the first and second pressing members along the first support member.

11. A sheet processing method, comprising:

stacking conveyed sheets on a stacking unit;

aligning the sheets stacked on the stacking unit in a sheet conveying direction by using an aligning unit; and moving a binding unit along an end portion on a binding portion side of a bundle of sheets, and causing the binding unit to perform a binding process for the bundle of the sheets that have been aligned by the aligning unit, wherein the binding process is performed by the binding unit in a state in which a pressing unit that moves in association with movement of the binding unit presses the end portion on the binding portion side of the bundle of sheets, moving, by a moving mechanism, when the pressing unit includes a plurality of pressing members and one of the pressing members moves in association with the binding unit, another one of the pressing members to be symmetric to the one of the pressing members, pressing, by first and second pressing members of the moving mechanism, both end portions of the bundle of the sheets;

pressing, by a third pressing member of the moving mechanism, a center portion of the bundle of the sheets;

supporting, by a first support member of the moving mechanism, the first and second pressing members in a slidable manner in a direction perpendicular to the sheet conveying direction;

biasing, by an elastic biasing unit of the moving mechanism, each of the first and second pressing members toward the third pressing member; and reciprocating, by the binding unit, in a direction perpendicular to the sheet conveying direction, moving, by an engaging member of the interlocking device that is engaged with the binding unit when the binding unit moves and is configured to be brought into contact with one of the first and second pressing members with the one of the first and second pressing members when the binding unit moves; and moving, by one of the first and second pressing members along the first support member, wherein a connecting unit allows another one of the first and second pressing members to perform an operation that is symmetric to the moving.

* * * * *